US012790791B2

(12) United States Patent
Rousell et al.

(10) Patent No.: US 12,790,791 B2
(45) Date of Patent: Nov. 10, 2026

(54) SYSTEMS, METHODS, AND MEDIA FOR INSTRUCTING POWER SHOVEL OPERATORS

(71) Applicant: Suncor Energy Inc., Calgary (CA)

(72) Inventors: Tobi Rousell, Calgary (CA); An Khac Do, Calgary (CA); Daniel Laverne Gray Luther, Calgary (CA)

(73) Assignee: Suncor Energy Inc., Calgary (CA)

( * ) Notice: Subject to any disclaimer, the term of this patent is extended or adjusted under 35 U.S.C. 154(b) by 292 days.

(21) Appl. No.: 18/728,372

(22) PCT Filed: Jan. 10, 2023

(86) PCT No.: PCT/CA2023/050021

§ 371 (c)(1),
(2) Date: Jul. 11, 2024

(87) PCT Pub. No.: WO2023/133629

PCT Pub. Date: Jul. 20, 2023

(65) Prior Publication Data

US 2025/0092641 A1 Mar. 20, 2025

(30) Foreign Application Priority Data

Jan. 13, 2022 (CA) ..... CA 3145559

(51) Int. Cl.
*E02F 9/26* (2006.01)
*E02F 9/20* (2006.01)

(52) U.S. Cl.
CPC ..... *E02F 9/264* (2013.01); *E02F 9/2054* (2013.01); *E02F 9/267* (2013.01)

(58) Field of Classification Search
CPC ... E02F 3/00; E02F 3/431; E02F 3/435; E02F 9/264; E02F 9/265; E02F 9/267;
(Continued)

(56) References Cited

U.S. PATENT DOCUMENTS 9,695,571 B1 * 7/2017 Ge ..... E02F 3/435
2017/0121933 A1 5/2017 Brandt et al.
(Continued)

OTHER PUBLICATIONS

International Search Report issued in corresponding PCT application No. PCT/CA2023/050021; dated Mar. 20, 2023.

*Primary Examiner* — Robert E Pezzuto
(74) *Attorney, Agent, or Firm* — CPST Intellectual Property Inc.; Brett J. Slaney

(57) ABSTRACT

Systems, methods, and media are described for instructing power shovel operators. Multiple types of information about the power shovel and other operations at a work site are integrated into a GUI in order to present power shovel operators with real-time visual feedback on operational decisions and actionable guidance on ongoing loading operations. The operator is presented with a user interface screen showing performance information such as a performance score indicating the operator's overall efficiency or effectiveness over a predetermined time period. The operator is presented with bucket load information to assist in deciding whether a current load of shoveled material in the bucket of the operator's power shovel should be loaded into a material transport vehicle (e.g., a haul truck), based on vehicle payload target information of the material transport vehicle. Other types of instruction are disclosed as part of the GUI.

21 Claims, 12 Drawing Sheets

(58) Field of Classification Search
CPC ..... E02F 9/2054; G01G 19/08; G01G 19/12; G01G 23/01; G07C 5/02; G09B 19/24; G09B 19/167
See application file for complete search history.

(56) References Cited

U.S. PATENT DOCUMENTS

| | | | | |
|---|---|---|---|---|
| 2017/0167109 | A1 | 6/2017 | Ge et al. | |
| 2018/0106709 | A1* | 4/2018 | Cherney | B60P 1/00 |
| 2020/0087893 | A1 | 3/2020 | Hageman et al. | |
| 2020/0131739 | A1* | 4/2020 | Ueda | E02F 3/283 |

* cited by examiner

SYSTEMS, METHODS, AND MEDIA FOR INSTRUCTING POWER SHOVEL OPERATORS

RELATED APPLICATION DATA

This application is a National Entry of PCT Application No. PCT/CA2023/050021, filed on Jan. 10, 2023, which claims priority to and benefit of Canadian Patent Application Serial No. 3,145,559, filed Jan. 13, 2022, "SYSTEMS, METHODS, AND MEDIA FOR INSTRUCTING POWER SHOVEL OPERATORS", the contents of which are incorporated herein by reference in their entirety.

FIELD

The present application generally relates to operation of power shovels, and in particular to systems, methods, and media for instructing and providing performance feedback to operators of power shovels.

BACKGROUND

Power shovels are machines used to dig and load material, such as earth and fragmented rock, typically for mineral extraction. Operation of a power shovel is a complex task requiring simultaneous attention to multiple types of information to maximize productive work while avoiding adverse consequences of sub-optimal operation of the power shovel, such as damage to equipment. Operators must be trained to understand how different operational decisions can positively or negatively affect productivity, and even trained operators often operate in an environment in which information relevant to efficient operations of the power shovel is either wholly unavailable or difficult to ascertain.

There thus exists a need for techniques for training and instructing operators of power shovels that enable efficient and safe operation.

SUMMARY

The present disclosure describes systems, methods, and media for instructing power shovel operators. Example embodiments described herein integrate multiple types of information about the power shovel and other operations at a work site in order to present power shovel operators with real-time visual feedback on operational decisions and actionable guidance on ongoing loading operations. In some embodiments, an operator is presented, on a display device, with a user interface screen showing performance information such as a performance score indicating the operator's overall efficiency or effectiveness over a predetermined time period (such as the current work shift, the current week, the current year, etc.). In some embodiments, an operator is presented, on the display device, with bucket load information to assist in deciding whether a current load of shoveled material in the bucket of the operator's power shovel should be loaded into a material transport vehicle (e.g., a haul truck), based on vehicle payload target information of the material transport vehicle.

In the present disclosure, the term "power shovel" refers to a machine such as a power shovel (i.e. a stripping shovel, front shovel, electric mining shovel, or electric rope shovel), an excavator, or another powered digging tool equipped with a bucket or dipper for shoveling and loading material, operated by a human operator who is empowered to control the shoveling and loading operations. A non-limiting example of a power shovel is described below with reference to FIGS. 2A-2B.

In the present disclosure, the term "GUI" refers to a graphical user interface, which is a form of user interface that allows users to interact with electronic devices through graphical icons. The terms "GUI screen", "UI screen" (i.e. "user interface screen"), or "screen" refer to a collection of GUI elements laid out in a fixed relation to one another within a 2D area, such as a rectangular area corresponding to the display surface of a display device.

In the present disclosure, the term "display device" refers to an electronic display configured to display visual information, such as an LED, LCD, or CRT monitor, either alone or in combination with other hardware and/or software components used to compute, render, and/or display information on the display. Thus, for example, each of the following can be considered a display device: a tablet computer with an LED display; the LED display in combination with a GPU and display driver of the tablet computer; and the LED display by itself.

In the present disclosure, the terms "material", "mineral material", or "shoveled material" refer to solid and/or liquid material shoveled by a power shovel. Shoveled material is typically collected in the bucket of the power shovel via a digging operation, before being transferred to a material transport vehicle, e.g., by being loaded into the bed of a haul truck or dump truck via a dumping operation of the power shovel.

In the present disclosure, the term "loading operation" refers to a sequence of one or more digging and dumping operations of a power shovel with respect to a single material transport vehicle. For example, a single loading operation can begin when a material transport vehicle arrives at the location of the power shovel, followed by several digging and dumping operations of the power shovel such that several bucket-loads of shoveled material are transferred into the bed of the material transport vehicle, and ending when the material transport vehicle leaves the location of the power shovel and drives to another location (such as a mineral processing facility).

In the present disclosure, statements that a second item (e.g., a signal, value, scalar, vector, matrix, calculation, or bit sequence) is "based on" a first item means that characteristics of the second item are affected or determined at least in part by characteristics of the first item. The first item can be considered an input to an operation or calculation, or a series of operations or calculations, that produces the second item as an output that is not independent from the first item.

In some aspects, the present disclosure describes a method for calibrating a bucket load weight measure for a power shovel within a work site, wherein the power shovel includes a bucket. Over a plurality of calibration cycles, wherein each one of the calibration cycles, independently, includes digging a material with the power shovel, such that the material becomes disposed within the bucket of the power shovel, and transferring the material to at least one material transport vehicle, with effect that a total amount of material is transferred from the bucket to the at least one material transport vehicle over the plurality of calibration cycles the method performs a number of steps. A bucket calibration measure representative of the total amount of material disposed within the bucket during the plurality of calibration cycles is obtained, wherein, for each one of the plurality calibration cycles, independently, a bucket sensor on the power shovel senses a weight of material disposed in the bucket and the bucket calibration measure is the cumulative sensed weight of material in the bucket across the plurality of calibration cycles. A vehicle calibration measure representative of the total amount of material disposed in the at least one material transport vehicle is obtained, wherein, for each one of the plurality of calibration cycles, independently, a vehicle sensor on the at least one material transport vehicle senses a weight of material transferred from the bucket to the material transport vehicle and the vehicle calibration measure is the cumulative sensed weight of material transferred to the at least one material transport vehicle across the plurality of calibration cycles. A calibration ratio of the bucket calibration measure to the vehicle calibration measure is determined. During operation of the power shovel in a loading operation comprising one or more transfers of material from the bucket to a current material transport vehicle: a working bucket load weight measure is obtained, representative of a weight of material disposed within the bucket of the power shovel, based on the bucket sensor; and a calibrated bucket load weight measure is generated based on the working bucket load weight measure and the calibration ratio.

In some examples, obtaining the bucket calibration measure and the vehicle calibration measure comprises: over a plurality of loading operations including the plurality of calibration cycles, obtaining unfiltered loading information from the bucket sensor and the vehicle sensor; pre-processing the unfiltered loading information to remove outlier data, thereby generating filtered loading information; and processing the filtered loading information to generate the bucket calibration measure and the vehicle calibration measure.

In some examples, pre-processing the unfiltered loading information to remove outlier data comprises: computing, for each unfiltered loading operation of the plurality of unfiltered loading operations, an unfiltered calibration ratio of the weight sensed by the bucket sensor during the unfiltered loading operation and the weight sensed by the vehicle sensor during the unfiltered loading operation; and selecting the plurality of calibration cycles from the unfiltered loading operations based the respective unfiltered calibration ratio for each unfiltered loading operation.

In some examples, the unfiltered loading information is selected by comparing the unfiltered calibration ratio to a pre-determined value.

In some examples, the pre-determined value is a calibration ratio derived from at least one previous calibration cycle, in accordance with one or more of the methods described above.

In some examples, the calibrated bucket load weight measure is generated by dividing the working bucket load weight measure by the calibration ratio to compute the calibrated bucket load weight measure.

In some examples, the method further comprises: during the loading operation, presenting to an operator of the power shovel, via a user output device, operator instruction information including bucket load information based on the calibrated bucket load weight measure.

In some examples, the method further comprises: during the loading operation, obtaining vehicle queue state information representative of a state of a queue of the one or more material transport vehicles at a current location of the power shovel; wherein the operator instruction information further includes vehicle queue information based on the vehicle queue state information.

In some examples, the vehicle queue state information includes: a vehicle queue length, representative of a number of the material transport vehicles in the queue.

In some examples, the vehicle queue state information includes a total vehicle time spent in the queue.

In some examples, the vehicle queue state information includes a total vehicle time lost to shovel relocation.

In some examples, the vehicle queue state information includes a number of material transport vehicles currently dispatched to the current location of the power shovel.

In some examples, the method further comprises processing the vehicle queue state information to generate a shovel relocation desirability value; wherein the operator instruction information further includes a relocation prompt based on the shovel relocation desirability value.

In some examples, the method further comprises processing the vehicle queue state information to generate a shovel relocation desirability value; wherein: the vehicle queue state information includes: a number of material transport vehicles in the queue; and a number of material transport vehicle currently dispatched to the current location of the power shovel; and the operator instruction information includes a relocation prompt based on the shovel relocation desirability value.

In some examples, the method further comprises: during the loading operation, obtaining a vehicular load weight measure representative of a current weight of the material transferred to the material transport vehicle; and processing the calibrated bucket load weight measure to generate a prospective vehicular load weight measure representative of an expected weight of the vehicle-contained shoveled material if the shoveled material held by the bucket of the power shovel is transferred to the material transport vehicle; wherein the operator instruction information further includes prospective vehicle load information based on the prospective vehicular load weight measure.

In some examples, the method further comprises obtaining incremental vehicle load information representative of, for each of one or more previous material transfers during the loading operation, a vehicular load weight measure after the material transfer; wherein the operator instruction information further includes the incremental vehicle load information.

In some examples, the method further comprises processing the prospective vehicle load information to determine that the material transport vehicle will be overloaded if the bucket load is transferred to the material transport vehicle; wherein the operator instruction information further includes warning information indicating a risk of overloading.

In some examples, the method further comprises obtaining vehicle payload target information representative of a target payload of the material transport vehicle; wherein processing the prospective vehicle load information to determine that the material transport vehicle will be overloaded if the bucket load is transferred to the material transport vehicle comprises comparing the vehicle payload target information to the prospective vehicle load information.

In some examples, wherein the vehicle payload target information is based at least in part on a vehicle type of the material transport vehicle.

In some examples, wherein the vehicle payload target information is based at least in part on a condition of the shoveled material.

In some examples, wherein the vehicle payload target information is based at least in part on a condition of a road surface of the work site.

In some examples, wherein the vehicle payload target information is based in part of a value set by a central dispatch server at the work site.

In some examples, the method further comprises: processing at least the shovel sensor data to determine an equipment fault condition of the power shovel; wherein the operator instruction information further includes equipment fault information indicating a possible equipment fault condition.

In some examples, the method further comprises: obtaining performance-related information including: vehicle queue state information representative of a state of a queue of material transport vehicles of the material transport vehicular fleet at a current location of the power shovel; and loading precision information representative of a precision of one or more of the calibration cycles of the plurality of calibration cycles; and processing the performance-related information to generate performance information; wherein the operator instruction information further includes the performance information.

In some examples, the vehicle queue state information includes one or more of the following: a vehicle queue length, representative of a number of the material transport vehicles in the queue; a total vehicle time spent in the queue; a total vehicle time lost to shovel relocation; and a number of material transport vehicle currently dispatched to the current location of the power shovel.

In some examples, the precision information is based on, for each of the one or more calibration cycles, a comparison between: a vehicular load weight measure representative of representative of a weight of a total amount of vehicle-contained shoveled material transferred to a material transport vehicle during the respective calibration cycle; and vehicle payload target information representative of a target payload of the respective material transport vehicle loaded during the respective calibration cycle.

In some examples, the performance-related information further includes shovel event information representative of the occurrence of one or more events adversely affecting a condition of the power shovel.

In some examples, the method further comprises: obtaining operator status information indicating that a second operator of the power shovel is undergoing training; presenting to the second operator, via the user output device, operator training information in place of the operator instruction information, the operator training information excluding the performance information.

In some aspects, the present disclosure describes a system for instructing an operator of a power shovel within a work site, comprising a display device, a processor, and a memory storing machine-executable instructions thereon which, when executed by the processor, cause the system to calibrate a bucket load weight measure for the power shovel. The power shovel includes a bucket. Over a plurality of calibration cycles, wherein each one of the calibration cycles, independently, includes digging a material with the power shovel, such that the material becomes disposed within the bucket of the power shovel, and transferring the material to at least one material transport vehicle, with effect that a total amount of material is transferred from the bucket to the at least one material transport vehicle over the plurality of calibration cycles, a number of steps are performed. A bucket calibration measure representative of the total amount of material disposed within the bucket during the plurality of calibration cycles is obtained, wherein, for each one of the plurality calibration cycles, independently, a bucket sensor on the power shovel senses a weight of material disposed in the bucket and the bucket calibration measure is the cumulative sensed weight of material in the bucket across the plurality of calibration cycles. A vehicle calibration measure representative of the total amount of material disposed in the at least one material transport vehicle is obtained, wherein, for each one of the plurality of calibration cycles, independently, a vehicle sensor on the at least one material transport vehicle senses a weight of material transferred from the bucket to the material transport vehicle and the vehicle calibration measure is the cumulative sensed weight of material transferred to the at least one material transport vehicle across the plurality of calibration cycles. A calibration ratio of the bucket calibration measure to the vehicle calibration measure is determined. During operation of the power shovel in a loading operation comprising one or more transfers of material from the bucket to a current material transport vehicle: a working bucket load weight measure is obtained, representative of a weight of material disposed within the bucket of the power shovel, based on the bucket sensor; and a calibrated bucket load weight measure is generated based on the working bucket load weight measure and the calibration ratio.

In some aspects, the present disclosure describes a non-transitory processor-readable medium having machine-executable instructions stored thereon which, when executed by a processor of a device, cause the device to calibrate a bucket load weight measure for a power shovel within a work site. The power shovel includes a bucket. Over a plurality of calibration cycles, wherein each one of the calibration cycles, independently, includes digging a material with the power shovel, such that the material becomes disposed within the bucket of the power shovel, and transferring the material to at least one material transport vehicle, with effect that a total amount of material is transferred from the bucket to the at least one material transport vehicle over the plurality of calibration cycles, a number of steps are performed. A bucket calibration measure representative of the total amount of material disposed within the bucket during the plurality of calibration cycles is obtained, wherein, for each one of the plurality calibration cycles, independently, a bucket sensor on the power shovel senses a weight of material disposed in the bucket and the bucket calibration measure is the cumulative sensed weight of material in the bucket across the plurality of calibration cycles. A vehicle calibration measure representative of the total amount of material disposed in the at least one material transport vehicle is obtained, wherein, for each one of the plurality of calibration cycles, independently, a vehicle sensor on the at least one material transport vehicle senses a weight of material transferred from the bucket to the material transport vehicle and the vehicle calibration measure is the cumulative sensed weight of material transferred to the at least one material transport vehicle across the plurality of calibration cycles. A calibration ratio of the bucket calibration measure to the vehicle calibration measure is determined. During operation of the power shovel in a loading operation comprising one or more transfers of material from the bucket to a current material transport vehicle: a working bucket load weight measure is obtained, representative of a weight of material disposed within the bucket of the power shovel, based on the bucket sensor; and a calibrated bucket load weight measure is generated based on the working bucket load weight measure and the calibration ratio.

In some aspects, the present disclosure describes a processor-readable medium having instructions tangibly stored thereon. The instructions, when executed by a processor device, cause the processor device to perform the steps of any of the methods described above.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

The present disclosure describes example devices, methods, systems, and media for instructing an operator of a power shovel.

Example Work Site

For simplicity, the present disclosure describes examples in the context of a work site, such as an open-pit mine, where a power shovel cooperates with a fleet of vehicles to dig, load, and transport shoveled material (such as mineral-containing earth and rock) to a material processing facility. It will be appreciated that examples described herein are equally suited for deployment in other types of work sites, such as construction sites in which an excavator or other power shovel is used to clear rubble or excavate earth and rock.

Figure 1:
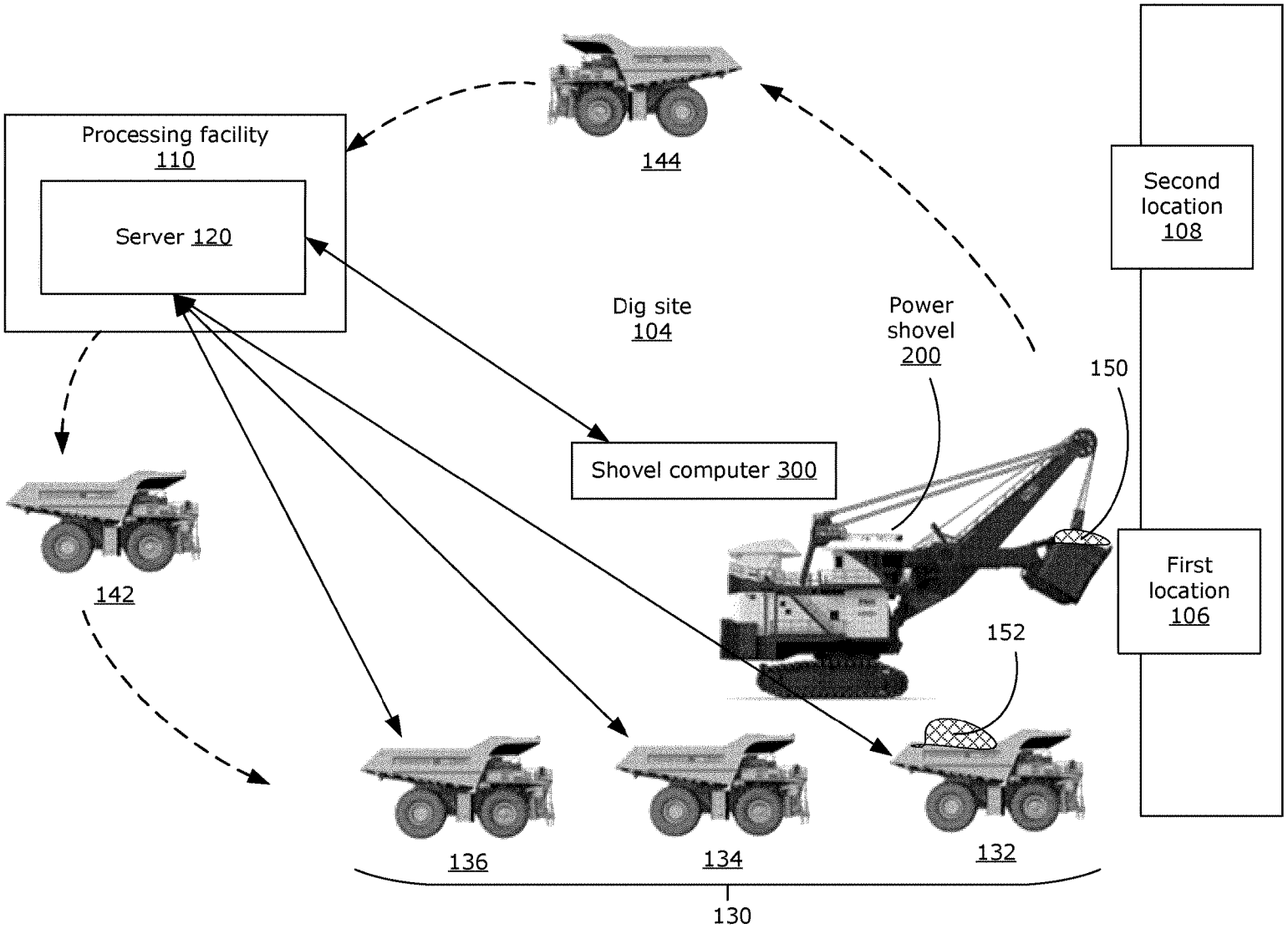
FIG. 1 is a schematic diagram showing a work site, showing an example environment in which examples described herein can operate.

FIG. 1 shows an example of a work site 104 where a power shovel 200 is operated to dig shoveled material and load the shoveled material onto a sequence of material transport vehicles. The power shovel 200 is shown in operation at a first location 106 of the work site 104. A queue 130 of material transport vehicles is shown at the first location 106 (i.e. the current location of the power shovel 200, such that three queued vehicles are shown: a current vehicle 132, at the front of the queue 130, which is currently being loaded by the power shovel 200; a second queued vehicle 134, at a second position of the queue 130; and a third and final queued vehicle 136, at a third and rear position of the queue 130. The queued vehicles 132, 134, 136 form part of a vehicle fleet, which can also include additional vehicles such as additional material transport vehicles. An incoming vehicle 142 is shown en route to the first location 106 from a processing facility 110, and a previously-loaded vehicle 144 is shown leaving the first location 106 en route to the processing facility 110; typically, vehicles in the vehicle fleet will be dispatched to and from locations by a dispatch system, as described further below. The processing facility 110 is a mineral extraction plant or other material processing facility for processing the shoveled material loaded onto the material transport vehicles. The material transport vehicles 132, 134, 136, 142, 144 are all shown as haul trucks; it will be appreciated that, in some embodiments, the material transport vehicles of the vehicle fleet can include various types of vehicles configured to transport shoveled material, such as various models of haul trucks, dump trucks, gravel trucks, rail cars, and/or other vehicles suitable for receiving and transporting shoveled material within a work site.

In FIG. 1, the power shovel 200 is shown with a quantity of bucket-contained shoveled material 150 held in the bucket of the power shovel 200. The current vehicle 132, which is currently being loaded by the power shovel 200, is shown with a quantity of vehicle-contained shoveled material 152 in the bed of the current vehicle 132. The vehicle-contained shoveled material 152 is shoveled material (e.g., earth and rock) that has been dug and transferred to the current vehicle 132 by the power shovel 200 during a current loading operation, i.e., during an operation in which the power shovel 200 loads one or more bucket loads of shoveled material into the vehicle before the vehicle leaves the location of the power shovel 200. In some examples, a loading operation can consist of a single bucket load of shoveled material being loaded into a material transport vehicle. In other examples, a loading operation can consist of two or more bucket loads of shoveled material being loaded into a material transport vehicle.

The work site 104 also includes a second location 108. In some examples, described below, the power shovel 200 can relocate from the first location 106 to the second location 108 in order to more effectively perform digging and loading. Such relocation can be time-consuming given the difficulty in maneuvering the power shovel 200, and some examples described below provide instruction to the operator of the power shovel 200 to minimize the idle time of the queued vehicles 132, 134, 136 lost to such relocation operations.

FIG. 1 also shows example locations for a server 120 (i.e., within the processing facility 110) and shovel computer 300 (i.e., within the power shovel 300), as described in detail below with reference to FIG. 3.

Figure 2A:
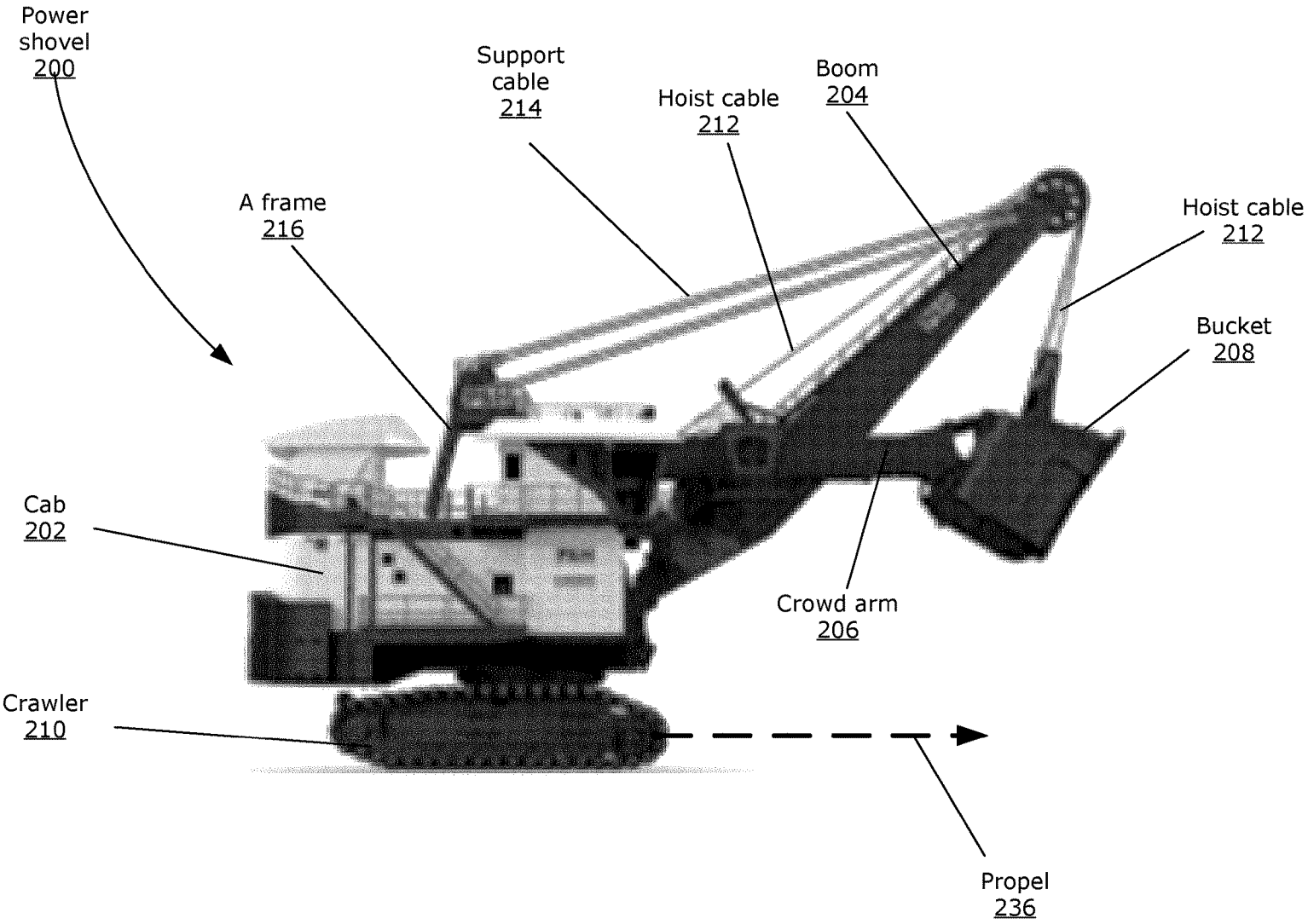
FIG. 2A is a side view of a power shovel, showing an example environment in which examples described herein can operate.

FIG. 2A shows an example power shovel 200. The power shovel 200 includes a cab 202 mounted on top of a crawler 210. The crawler 210 is typically a set of treads and/or wheels configured to propel 236 the power shovel 200 across a ground surface. The operator resides inside the cab 202, which also houses a power source (such as a battery and/or internal combustion engine) and actuation means for the hoisting and crowding components (such as winches, drive trains, and/or hydraulic systems). A support cable 214 suspending a boom 204 is anchored to an A-frame 216 mounted on the cab 202. The boom 204 provides a pulley for a hoist cable 212 actuated by a winch inside the cab 202 at its proximal end. The distal end of the hoist cable 212 is attached to the bucket 208 (also called a dipper), which is configured to pivot on the distal end of a crowd arm 206 (also called a dipper stick, stick, or dipper handle).

In some examples, relocating the power shovel 200 from the first location 106 to the second location 108 involves propelling 236 the power shovel 200 using the crawler 210.

Figure 2B:
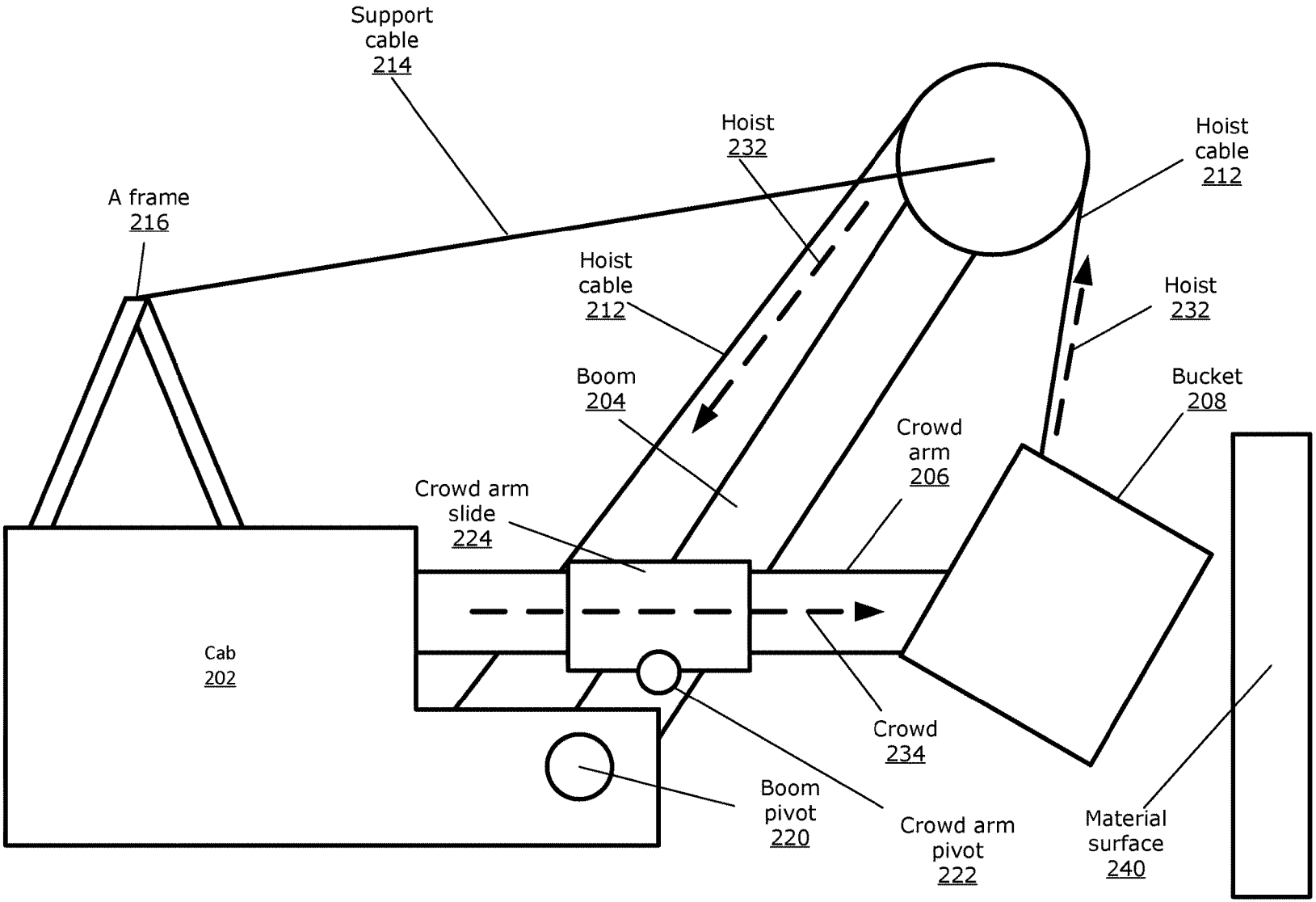
FIG. 2B is a partial side view of a power shovel showing details of hoisting and crowding components, showing an example environment in which examples described herein can operate.

FIG. 2B shows further details of the hoisting and crowding components of the power shovel 200 of FIG. 2A. A crowd arm pivot 222 establishes a pivotal relationship between the crowd arm slide 224 and the boom 204. A boom pivot 220 establishes a pivotal relationship between the cab 202 and the boom 204. Typically, the support cable 214 is of a fixed length, and the only time that the boom 204 pivots on the boom pivot 220 is when the boom 204 is forced backward or upward by a collision: such collisions can lead to a bouncing movement of the boom 204 as it pivots back downward sue to gravity, placing significant strain on the hoist cable 212 and/or support cable 214. Such collisions and bounces, sometimes called boom jacking and slack rope events, pose a significant risk of damaging the equipment, and can be monitored and reported as described below in some examples.

The crowd arm 206 is configured to move along a crowd axis 234 to position the bucket 208 horizontally closer or farther relative to the cab 202. A crowd arm slide 224 (also called a saddle block in some examples) establishes sliding relationship between the crowd arm 206 and the crowd arm pivot 222 along the crowd axis 234. In some examples, the crowd arm slide 224 includes a gearbox; in other examples, the gearbox for actuating the crowd arm 206 is located inside the cab 202, near the winch for actuating the hoist cable 212.

The hoist cable 212 extends and retracts along the axis of hoist 232, actuated by the winch (or other actuator) inside the cab 202, thereby translating the bucket 208 and pivoting and/or sliding the crowd arm 206. Thus, in operation, through a combination of the actuation of the hoist cable 212 (i.e. hoisting or lowering) and the actuation of the crowd arm (i.e. crowding inward or outward), the bucket 208 is manipulated to dig material from a material surface 240 (shown as vertical, but can be any shape or orientation) and load the shoveled material into or onto a receptacle such as the bed of a haul truck.

Figure 3:
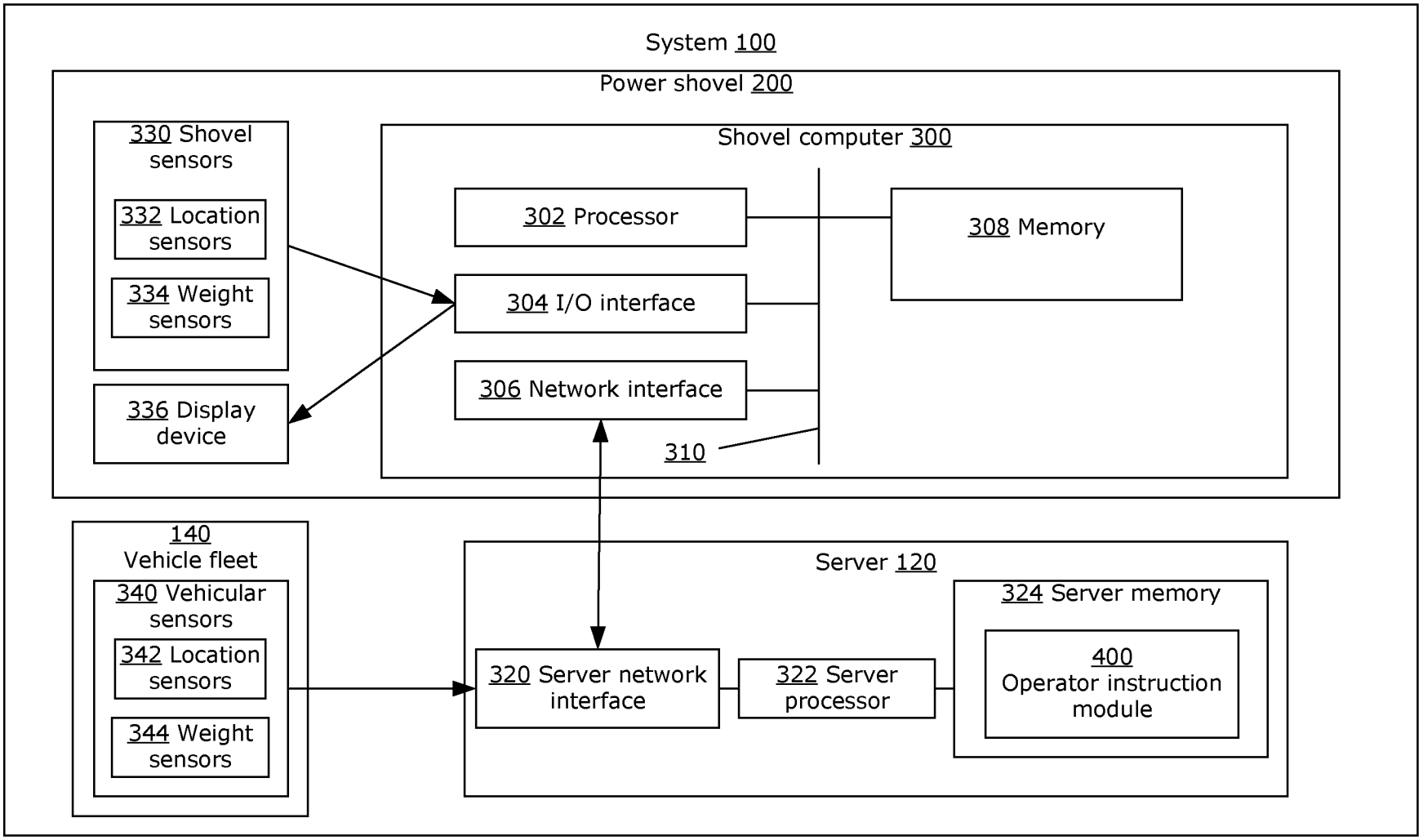
FIG. 3 is a block diagram illustrating some components of an example system for instructing an operator of a power shovel, in accordance with examples described herein.

FIG. 3 is a block diagram of a system 100 including the shovel computer 300 and server 120. Although an example embodiment of each of the shovel computer 300 and server 120 are shown and discussed below, other embodiments can be used to implement examples disclosed herein, which can include components different from those shown. Although FIG. 2 shows a single instance of each component of the shovel computer 300 and server 120, there can be multiple instances of each component shown.

The shovel computer 300 includes one or more processors, such as a central processing unit, a microprocessor, an application-specific integrated circuit (ASIC), a field-programmable gate array (FPGA), a dedicated logic circuitry, a tensor processing unit, a neural processing unit, a dedicated artificial intelligence processing unit, or combinations thereof. The one or more processors are collectively referred to as a "processor device" or simply a processor 302. The shovel computer 300 also includes one or more input/output (I/O) interfaces, collectively referred to as I/O interface 304, which interfaces with output devices such as a display device 336 (which can include user input components such as a touchscreen), and input devices such as shovel sensors 330 (shown to include one or more location sensors 332 and one or more weight sensors 334). The shovel computer 300 can also interface with other input devices (e.g., buttons, microphone, touchscreen, keyboard, etc.) and other output devices (e.g., speaker, vibration unit, etc.) included in the system 100.

The weight sensors 334 (and optionally the location sensors 332) of the power shovel 200 form a power shovel sensor configuration, which generates shovel sensor data used by the operator instruction module 400 as described below. The weight sensors 334 can be load sensors or other sensors suitable for sensing the weight of a load of shoveled material held by the bucket 208, which may also be referred to herein as "bucket sensors". The locations sensors 332 can include a GPS sensor for detecting the location of the power shovel 200 within the work site 104.

The shovel computer 300 includes one or more network interfaces 306 for wired or wireless communication with a network (e.g., an intranet, the Internet, a P2P network, a WAN and/or a LAN) or other node. The network interface(s) 306 can include wired links (e.g., Ethernet cable) and/or wireless links (e.g., one or more antennas) for intra-network and/or inter-network communications. In some embodiments, one or more network interfaces 306 can be used as, or instead of, the I/O interface 304 for communication with one or more of the input devices and/or output devices described above, for example using 802.11 or Bluetooth™ wireless communication.

The shovel computer 300 includes one or more memories, collectively referred to as memory 308, which can include a volatile or non-volatile memory (e.g., a flash memory, a random access memory (RAM), and/or a read-only memory (ROM)). The non-transitory memory 308 can store machine-executable instructions for execution by the processor 302, such as to carry out examples described in the present disclosure. The memory 308 can include other software instructions, such as for implementing an operating system and other applications or functions.

The server 120 similarly includes a server processor 322, server memory 324, and server network interface 320, which can take any of the same forms as those described above for the processor 302, memory 308, and network interface 306, respectively, of the shovel computer 300. A set of machine-executable instructions defining an operator instruction module 400 is shown stored in the server memory 324, which can be executed by the server processor 322 (or by the system 100, i.e. by some combination of the server processor 322 and shovel computer processor 302) to perform the steps of the methods described herein. The operation of the system 100 in executing the operator instruction module 400 is described below with reference to FIG. 4.

The server 120 is in communication with the vehicle fleet 140 via the server network interface 320 and may be referred to herein as a "central dispatch server". Specifically, the server network interface 320 is configured to receive vehicular sensor data from one or more sensors of the material transport vehicles of the vehicle fleet 140, including one or more weight sensors 344 and optionally one or more location sensors 342 of the material transport vehicles. The weight sensors 344 (and optionally the location sensors 342) of the vehicle fleet 140 form a vehicular sensor configuration, which generates vehicle sensor data used by the operator instruction module 400 as described below. The weight sensors 344 can be load sensors or other sensors suitable for sensing the weight of a load of shoveled material held by the bed of a respective material transport vehicle. In some examples, each material transport vehicle includes a plurality of weight sensors 344 for sensing the loaded weight of the vehicle, as well as a location sensor (e.g., a GPS sensor) for determining the location of the vehicle within the work site 104.

The methods and operations of various software-based modules described herein will be described with reference to the operator instruction module 400 implemented by software executed by the server processor 322, with the shovel computer 300 largely operating to display GUI screens (such as examples of GUI screen 900 described below with reference to FIGS. 9-9B) to the operator of the power shovel 200. In some such embodiments, the shovel computer 300 can be regarded as a "display device" serving primarily to display information processed and generated by the server 120. However, it will be appreciated that in various embodiments the data processing steps or operations of the operator instruction module 400 can be performed on either or both of the server 120 and/or shovel computer 300, such that the system 100 as a whole performs the method steps or operations of the operator instruction module 400.

In some examples, the shovel computer 300 and/or server 120 can also include one or more electronic storage units (not shown), such as a solid state drive, a hard disk drive, a magnetic disk drive and/or an optical disk drive. In some examples, one or more data sets and/or modules can be provided by an external memory (e.g., an external drive in wired or wireless communication with the shovel computer 300) or can be provided by a transitory or non-transitory computer-readable medium. Examples of non-transitory computer readable media include a RAM, a ROM, an erasable programmable ROM (EPROM), an electrically erasable programmable ROM (EEPROM), a flash memory, a CD-ROM, or other portable memory storage.

The components of the shovel computer 300 can communicate with each other via various means, such as a data bus 310. The components of the server 120 can similarly communicate with each other via a data bus or similar. In some embodiments, the operations of the shovel computer 300 and/or the server 120 can be performed by a distributed computing system, such as a cloud computing system or a virtual machine instance implemented over one or more servers.

Example Operator Instruction Module

Figure 4:
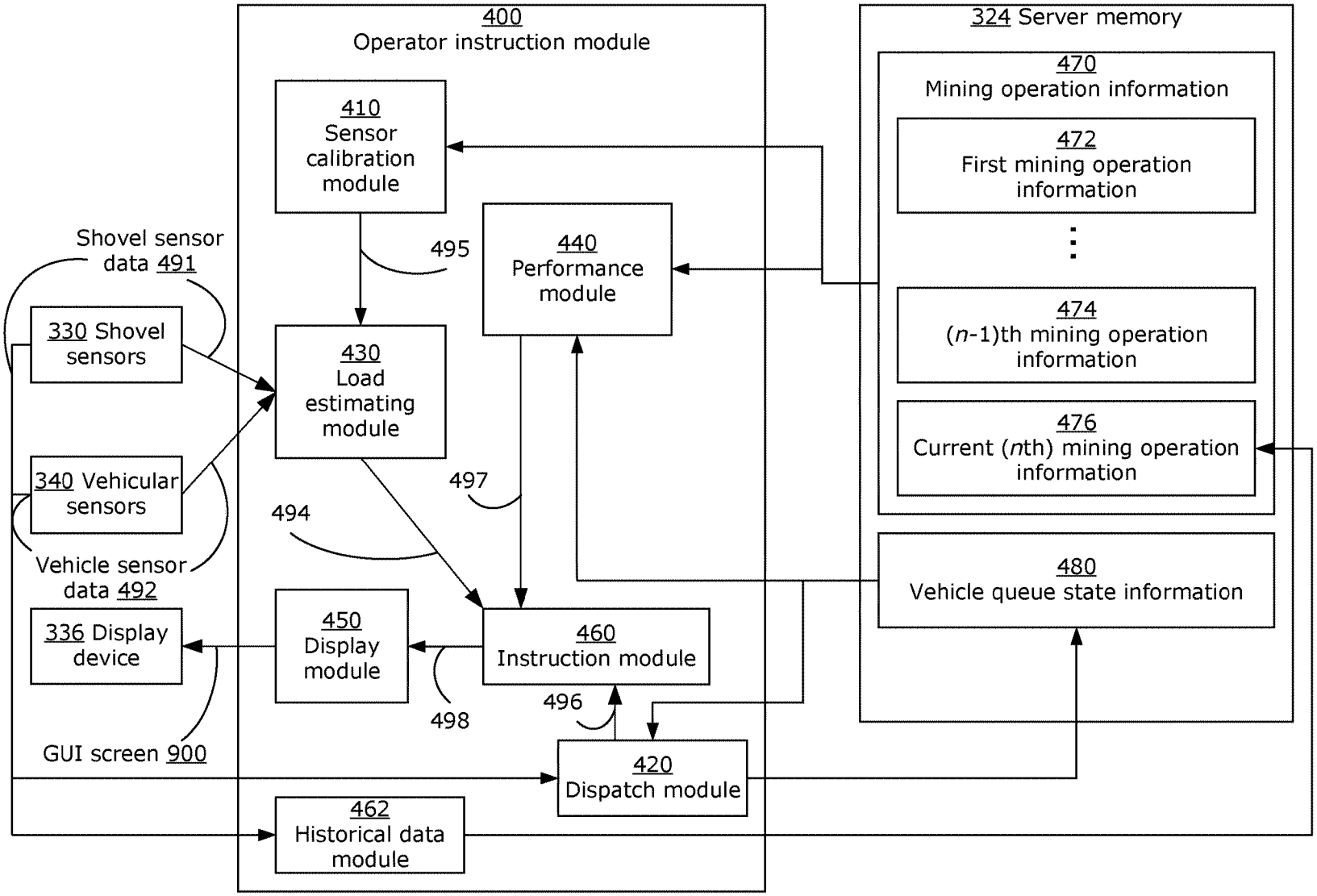
FIG. 4 is a schematic diagram showing the operation of an example embodiment of the operator instruction module of FIG. 3.

FIG. 4 illustrates an example operator instruction module 400 executed by the server 120. Whereas the operator instruction module 400 is described herein as implemented by machine-executable instructions executed by the processor 302 and/or server processor 322, in some embodiments one or more operations of the operator instruction module 400 can be performed by specialized hardware (such as an application-specific integrated circuit (ASIC)) or by a separate computing device or platform within the system 100.

The operator instruction module 400 includes several functional modules (sometimes referred to as sub-modules): a sensor calibration module 410, a dispatch module 420, a load estimating module 430, a performance module 440, a display module 450, an instruction module 460, and a historical data module 462.

The operations, functional modules, inputs, and outputs shown in FIG. 4 will be described in detail in the context of example methods 500, 600, 700, 800 for instructing an operator of a power shovel, illustrated in the flowcharts of FIGS. 5-8.

Example Methods for Instructing an Operator of a Power Shovel

In the example embodiments described below with reference to FIGS. 5-8, the methods 500, 600, 700, and 800 are performed by the operator instruction module 400 as part of the system 100. However, it will be appreciated that other embodiments can practice the steps of the methods 500, 600, 700, and 800 using other components that perform similar functions.

Figure 5:
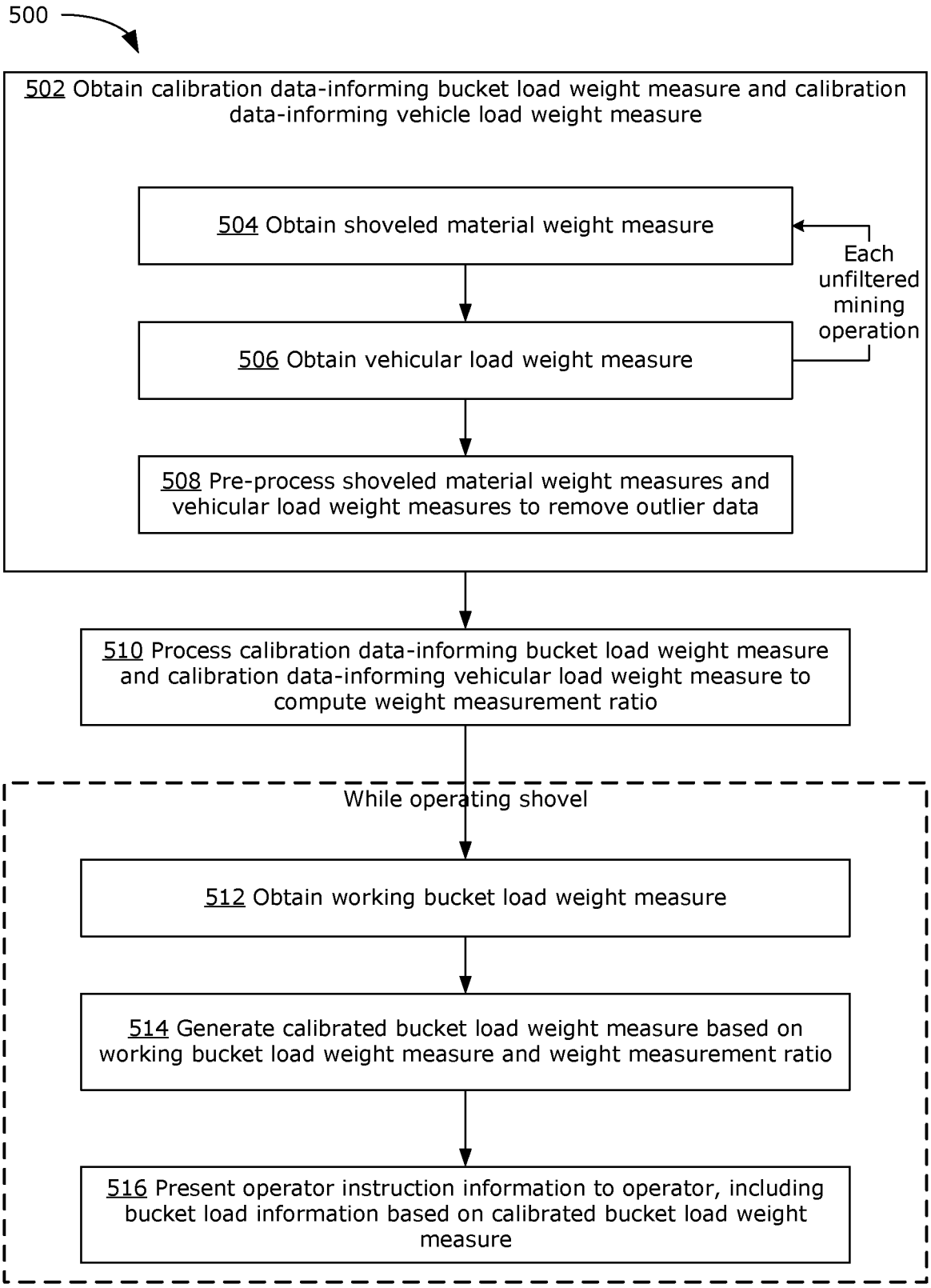
FIG. 5 is a flowchart illustrating steps of a first example method for instructing an operator of a power shovel, in accordance with examples described herein.

FIG. 5 is a flowchart showing steps of a first example method 500 for instructing an operator of a power shovel. The method 500 begins at step 502. At 502, the operator instruction module 400 obtains, over a plurality of calibration cycles, a bucket calibration measure, representative of a weight of a total amount of bucket-contained shoveled material 150, and a vehicle calibration measure, representative of a weight of a total amount of vehicle-contained shoveled material 152. Each of the calibration cycles includes transferring bucket-contained shoveled material 150, that is disposed within the bucket 208 of the power shovel 200, to at least one material transport vehicle (e.g., current vehicle 132), with effect that a vehicle-contained shoveled material 152 becomes emplaced within the at least one material transport vehicle, such that a plurality of material transfers is effectuated over the plurality of calibration cycles, and such that, over the plurality of material transfers, a total amount of bucket-contained shoveled material 150 is transferred to a material transport vehicular fleet, defined by at least one fleet vehicle, the at least one fleet vehicle including the at least one material transport vehicle, with effect that a total amount of vehicle-contained shoveled material 152 becomes emplaced within the material transport vehicular fleet 140.

In the illustrated embodiment, step 502 includes sub-steps 504, 506, and 508 for obtaining unfiltered sensor data and filtering out outlier data during pre-processing. Steps 504 and 506 are repeated for each of a plurality of unfiltered loading operations. The plurality of unfiltered loading operations includes the plurality of calibration cycles.

At 504, the historical data module 462 obtains a shoveled material weight measure, based on the shovel sensor data 491 (i.e. data from the shovel weight sensor 334), representative of a weight of a total amount of bucket-contained shoveled material 150 transferred to a material transport vehicle (e.g., previously-loaded vehicle 144) during the unfiltered loading operation. The shoveled material weight measure is generated by the power shovel sensor configuration of the power shovel 200 in response to sensing of a weight of the bucket-contained shoveled material 150 loaded during the unfiltered loading operation.

At 506, the historical data module 462 obtains a vehicular load weight measure, based on the vehicle sensor data 492 (i.e. data from the vehicle fleet weight sensors 344), representative of a weight of a total amount of vehicle-contained shoveled material 152 transferred to the material transport vehicle (e.g., previously-loaded vehicle 144) during the unfiltered loading operation. The vehicular material weight measure is generated by the vehicular sensor configuration of the material transport vehicular fleet 140 (i.e. of the material transport vehicle being loaded during the unfiltered loading operation) in response to sensing of a weight of the vehicle-contained shoveled material 152 loaded during the unfiltered loading operation.

The historical data module 462 stores the shoveled material weight measure and vehicular load weight measure in the server memory 324 as loading operation information 470. The shoveled material weight measure and vehicular load weight measure for each unfiltered loading operation are stored as loading operation information 470 of a respective unfiltered loading operation, e.g., first loading operation information 472 through (n−1)th loading operation information 474.

At 508, the sensor calibration module 410 pre-processes the unfiltered loading information (i.e., the shoveled material weight measures and vehicular load weight measures stored as, e.g., the first loading operation information 472 through (n−1)th loading operation information 474) to remove outlier data, thereby generating the bucket calibration measure and the vehicle calibration measure.

In some embodiments, pre-processing the unfiltered loading information to remove outlier data includes computing an unfiltered loading operation weight measurement ratio for each unfiltered loading operation. The unfiltered loading operation weight measurement ratio is representative of a ratio between the shoveled material weight measure and the vehicular load weight measure of the respective unfiltered loading operation. After computing the unfiltered loading operation weight measurement ratio for each unfiltered loading operation, those unfiltered loading operations having weight ratios within a given range can be selected as the calibration cycles. For example, the range can be determined based on an average and variance of the weight ratios of the unfiltered loading operations, can be a predetermined range (e.g., from 0.9 to 1.1), or can be a range determined by other means suitable for identifying and eliminating outlier data points. Because the weight ratio of an unfiltered loading operation (i.e. the unfiltered loading operation weight measurement ratio) represents a degree of alignment or misalignment between the shovel weight sensors 334 and the vehicle weight sensors 344, a ratio falling outside of the range can be discarded as it likely corresponds to an anomalous event such as a malfunctioning sensor, spillage of material from the bucket 208 or from the bed of the vehicle, etc.

In some embodiments, outlier data points can be identified and discarded using a unit other than the loading operation as representative of a single data point. For example, in some embodiments, a loading operation can include multiple material transfers of a bucket load of shoveled material from the bucket 208 to the vehicle, but each such material transfer can be treated as a separate data point, with its respective shoveled load weight measure and vehicle load weight measure kept or discarded based on a computed ratio therebetween. It will be appreciated that other units of measurement can be used as data points to be filtered by the sub-steps of step 502.

Thus, the plurality of calibration cycles, used to determine the bucket calibration measure and vehicle calibration measure, are selected from the unfiltered loading operations by collecting data and discarding outlier data points in sub-steps 504 through 508. The shoveled material weight measure and the vehicular load weight measure of each calibration cycle can thus be referred to as the "filtered loading information".

The method 500 then proceeds to step 510. At 510, the sensor calibration module 410 processes the bucket calibration measure and the vehicle calibration measure to compute a calibration ratio 495 of the bucket calibration measure to the vehicle calibration measure. In some embodiments, the calibration ratio 495 is computed as a straightforward ratio between the bucket calibration measure and the vehicle calibration measure. In other embodiments, the calibration ratio 495 is calculated as an average or a weighted average of the weight ratios of the various loading operations or other data points (as described above). For example, if the first unfiltered loading operation has a shoveled load weight measure of 4 tons and a vehicle load weight measure of 4.4 tons (stored as first loading operation information 472), and a second unfiltered loading operation has a shoveled load weight measure of 2 tons and a vehicle load weight measure of 2.1 tons, then the calibration ratio 495 can be computed as ((4/4.4)+(2/2.1))/2 in some embodiments (i.e., 0.9307), or as (4+2)/(4.4+2.1) in other embodiments (i.e., 0.9230). It will be appreciated that computing an average ratio between shovel weight sensor readings and vehicle weight sensor readings over a plurality of loading operations (and therefore typically over a plurality of vehicles) can be implemented in various different ways.

While an operator is operating the power shovel 200, the method performs steps 512, 514, and 516. Steps 512 through 516 can be regarded as taking place during a single material transfer of shoveled material from the bucket 208 of the power shovel 200 to the bed of a material transport vehicle during a current loading operation (i.e., while loading current vehicle 132).

At 512, the load estimating module 430 obtains a working bucket load weight measure. The working bucket load weight measure is representative of a weight of shoveled material currently held by the bucket of the power shovel (i.e. bucket-contained shoveled material 150), based on sensor data generated by the sensor configuration of the power shovel (i.e. shovel sensors 330, and specifically weight sensors 334). For example, if the shovel weight sensors 334 indicate a weight of 1.1 tons of bucket-contained shoveled material 150 currently held by the bucket 208, then the working bucket load weight measure is 1.1 tons.

At 514, the load estimating module 430 generates a calibrated bucket load weight measure based on the working bucket load weight measure and the calibration ratio 495 computed by the sensor calibration module 410. For example, if the working bucket load weight measure is 1.1 tons, and the calibration ratio 495 (i.e. the ratio of bucket weight sensor readings to truck weight sensor readings) is 0.9230, then the calibrated bucket load weight measure can be computed as (1.1 tons)/(0.9230)=1.192 tons. The calibrated bucket load weight measure is therefore representative, in at least some embodiments, of an estimated weight of the current bucket-contained shoveled material 150 as it would be measured by the vehicle weight sensors 344.

The calibration performed by the sensor calibration module 410 thus adjusts weight sensor readings from the power shovel (i.e. from the weight sensors 334), during operation of the power shovel 200, to reflect the weight of the current bucket-load of shoveled material as it is likely to be measured by the vehicle weight sensors 344, as an average over multiple vehicles in the vehicle fleet 140. For example, in various examples, the calibration computation could be configured to be performed over the last five loading operations (e.g., the last five vehicles loaded); over all loading operations during a current work shift; over all loading operations over the operator's work history; over all loading operations over the operational lifetime of the power shovel 200; and so on. By averaging the calibration ratio 495 computation over multiple previous vehicle loading operations, examples described herein can improve the accuracy of the calibration relative to the vehicle fleet 140 as a whole.

At 516, the instruction module 460 generates operator instruction information 498, which is presented to the operator via a user output device (such as display device 336). The operator instruction information 498 includes bucket load information based on the calibrated bucket load weight measure. The load estimating module 430 generates load estimating information 494 based on the calibrated bucket load weight measure and sends the load estimating information 494 to the instruction module 460. In some embodiments, the load estimating information 494 is based on other information as well, as described below with reference to method 700 of FIG. 7. The instruction module 460 then generates the operator instruction information 498 based on the load estimating information 494.

In the illustrated embodiment of FIG. 4, the operator instruction information 498 is processed by the display module 450 to generate a GUI screen 900 (such as example GUI screen 900 described with reference to FIG. 9 below). The GUI screen 900 includes the operator instruction information 498, which includes the bucket load information based on the calibrated bucket load weight measure. Thus, the operator is presented with a visual representation of the calibrated bucket load weight measure. This visual representation of the calibrated bucket load weight measure can be used to assist the operator in operating the power shovel 200 effectively, as described in greater detail below with reference to method 700 of FIG. 7.

In some embodiments, for example, the sensor calibration module 410 computes the calibration ratio 495 with reference to the last N loading operations (i.e., the last N trucks to receive material from the shovel, where N is an integer such as 100).

In some embodiments, for example, the outlier data can be removed at step 508 with reference to several factors when considering whether to include or exclude data on a given previous loading operation from the calculation of the calibration ratio 495 at step 510. Examples of such factors, described below, include the age of the loading operation data, the percentage by which the loading operation data differs from a perfect 1:1 match between truck sensor readings and bucket sensor readings, the overall weight of material transferred during the loading operation, the overall calibration ratio for the loading operation, the presence or absence of carryback detected in the truck, the number of material transfers of the loading operation, and the latency of the loading operation. In some examples, the sensor calibration module 410 uses only a fixed number of data samples (each data sample being representative of a loading operation) to calculate the calibration ratio 495, such as 20 data samples, even if additional data samples are available that satisfy the various factors.

The age of the loading operation (e.g., the time difference between when the loading operation was completed and the present time) can be used to filter out data on loading operations over a certain age (e.g. over 6 hours old).

The last computed calibration ratio 495 can be applied to the bucket weight sensor readings of each material transfer during the loading operation to compute an "adjusted payload weight" of the truck based on shovel weight sensors readings. In some examples, the adjusted payload weight of the truck excludes any carryback amount of material remaining in the truck before the loading operation begins, i.e. it indicates only the weight of material transferred from the shovel to the truck during the loading operation. The sum of the bucket weight sensor readings for each material transfer during the loading operation (i.e. the weight of material transferred to the material transport vehicle during the loading operation, as indicated by the shovel sensors), is divided by the last computed calibration ratio 495 to calculate the adjusted payload weight of the truck. The adjusted payload weight of the truck can then be compared to a baseline value by adding the weight of the carryback amount of material remaining in the truck before the loading operation, dividing the result by the truck weight sensor reading following the material transfer (i.e. the weight of material transferred to the material transport vehicle by the material transfer, as indicated by the vehicle sensors), multiplying the result by 100, and subtracting 100, thereby generating a percentage value by which the calibration ratio 495 resulting from the material differs from a perfectly equal truck sensor-to-bucket sensor reading ratio of 1:1. Thus, the percentage value is calculated as (adjusted payload weight based on shovel sensors+carryback material weight in the truck)/(truck payload based on truck weight sensor reading)*100−100. This percentage value can be used at step 508 to remove data on material transfers having an absolute percentage value over a certain threshold (e.g., over 25% off, indicating a severe mismatch between bucket sensor readings and truck sensor readings).

The overall calibration ratio for the loading operation can be used to remove outlier data at step 508. For example, data on any loading operation in which the calibration ratio 495 calculated based only on that loading operation is above a maximum threshold (e.g., 150%) or below a minimum threshold (e.g., 50%) might indicate a miscalibration of sensors or other malfunction and can be excluded from the calculation at step 510.

The overall weight of material transferred during the loading operation can be used to remove outlier data at step 508. For example, data on any loading operation in which the amount of material transferred from the shovel to the truck is above a maximum threshold (e.g., above 500 short tons) and/or below a minimum threshold (e.g., below 250 short tons) can be excluded from the calculation at step 510.

The presence or absence of carryback detected in the truck can be used to remove outlier data at step 508. If the truck does not report any carryback at the beginning of the loading operation, this can indicate an error with the truck's sensors or reporting processes, and the loading operation data can be removed or disregarded.

The number of material transfers of the loading operation can be used to remove outlier data at step 508. For example, loading operations involving fewer than 3 or more than 7 material transfers can indicate unusual activity, and such data can be removed or disregarded.

The latency of the loading operation can be used to remove outlier data at step 508. For example, loading operations with a latency of more than 60 seconds (e.g. more than 60 seconds between the time of the shovel sensor reading and the time of the truck sensor reading) might have errors in measurement introduced by the latency, and such data can be removed or disregarded.

After a set of data samples to be used in the calculation is selected at step 508 (e.g., by identifying data from 20 loading operations that satisfy the factors above), the calibration ratio 495 can be calculated at step 510 by averaging the bucket calibration measure of each selected loading operation, averaging the vehicle calibration measure (excluding carryback) of each selected loading operation, and calculating the calibration ratio 495 as a ratio between the two averages.

Figure 6:
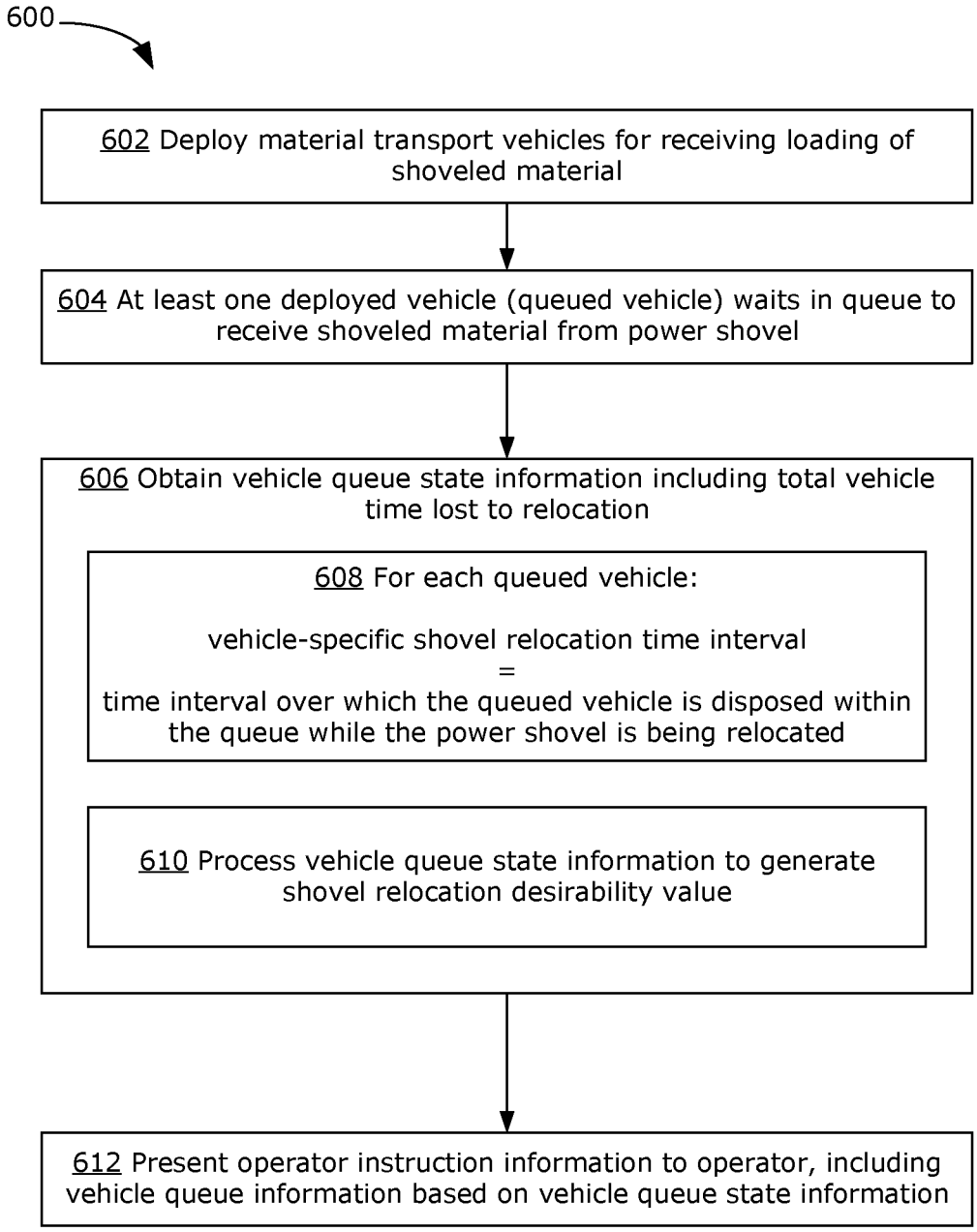
FIG. 6 is a flowchart illustrating steps of a second example method for instructing an operator of a power shovel, in accordance with examples described herein.

FIG. 6 is a flowchart showing steps of a second example method 600 for instructing an operator of a power shovel. The method 600 begins at step 602. At 602, a plurality of material transport vehicles are deployed for receiving loading of shoveled material. The material transport vehicles can consist of some or all of the material transport vehicles of the vehicle fleet 140. Over time, at least some of the deployed material transport vehicles arrive at the location of the power shovel 200 (e.g., first location 106) to receive loading of shoveled material that the power shovel 200 has shoveled from the work site 104.

At 604, at least one of the deployed vehicles spends time waiting, in a queue 130 of material transport vehicles, for receiving loading of the shoveled material: i.e., it is a queued vehicle such as current vehicle 132, second queued vehicle 134, or third queued vehicle 136.

At 606, the dispatch module 420 obtains vehicle queue state information 480 representative of a state of the queue 130 of material transport vehicles. Step 606 includes sub-steps 608 and 610.

While the queued vehicle is waiting in the queue, the location sensor 342 of the queued vehicle sends vehicle location sensor data (i.e., part of the vehicle sensor data 492) to the server network interface 320. The dispatch module 420 processes the vehicle location sensor data received from the various vehicles of the vehicle fleet 140 to identify which vehicles are queued at the location of the power shovel 200. In some embodiments, this processing includes identifying the location of the queued vehicle as being proximate (e.g., within a predefined distance) to the power shovel 200 (based on, e.g., the location sensor data received from the power shovel location sensor 332 as part of the shovel sensor data 491). In some embodiments, this processing includes identifying vehicles that are not moving, or that are not moving above a travelling threshold speed. In some embodiments, this processing includes identifying the queued vehicles based on information other than location sensor data, for example by identifying that a vehicle has been dispatched to the location of the power shovel 200, and the operator of the vehicle has manually indicated that the vehicle has arrived and is queued.

The processing of the vehicle location sensor data (and/or other data as described above) results in the generation of vehicle queue state information 480. The vehicle queue state information 480 can thereby be generated based on location data from multiple vehicles over time. By processing the vehicle location sensor data and/or other information received from each queued vehicle, the dispatch module 420 can determine how long (i.e. for what duration of time) each queued vehicle has been in the queue 130. This information is stored as part of the vehicle queue state information 480. The vehicle queue state information 480 can also include information such as a current number of queued vehicles; a total vehicle time spent in the queue 130 by the queued vehicles (i.e., the sum of the duration of time each currently queued vehicle has been in the queue 130); and a number of material transport vehicle currently dispatched to the current location of the power shovel (such as, e.g., incoming vehicle 142).

The dispatch module 420 also receives location information from the location sensor(s) 332 of the power shovel 200, and/or other information from the power shovel 200 indicating that the power shovel 200 is being relocated. For example, the power shovel operator can activate the crawler 210 to relocate the power shovel 200 from the first location 106 to the second location 108; activation of the crawler 210 can result in information being sent from the shovel computer 300 to the server 120 indicating that the power shovel 200 is being relocated.

At sub-step 608, the dispatch module 420 processes the information from the power shovel 200 indicating a time period in which the power shovel 200 is being relocated, as well as the other vehicle queue state information 480 described above, to compute, for each queued vehicle, a vehicle-specific shovel relocation time interval, representative of a time interval over which the queued vehicle is disposed within the queue 130 while the power shovel 200 is being relocated from the first location 106 to the second location 108. The dispatch module 420 then computes a total vehicle time lost to relocation as the sum of the vehicle-specific shovel relocation time intervals for all queued vehicles in the queue 130 during the relocation operation.

At sub-step 610, the dispatch module 420 further processes the vehicle queue state information 480 to generate a shovel relocation desirability value. The shovel relocation desirability value can be generated based on vehicle queue state information 480 such as the current number of queued vehicles and the number of material transport vehicle currently dispatched to the current location of the power shovel 200: for example, the power shovel 200 can have a high shovel relocation desirability value when the queue 130 is empty and no vehicles are currently dispatched to the location of the power shovel 200 (or any vehicles dispatched and en route are far away from the location of the power shovel 200); in contrast, the power shovel 200 can have a low shovel relocation desirability value when the queue 130 includes multiple vehicles that have been in the queue for a long period of time, and/or multiple vehicles currently dispatched the location of the power shovel 200.

The dispatch module 420 processes the vehicle queue state information 480 and/or the information received from the power shovel 200 to generate vehicle queue information 496. In some embodiments, the vehicle queue information 496 includes the total vehicle time lost to relocation. In some embodiments, the vehicle queue information 496 includes information based on the shovel relocation desirability value. For example, in some embodiments, the vehicle queue information 496 includes a relocation prompt based on the shovel relocation desirability value (e.g., information prompting the operator of the power shovel 200 to relocate the power shovel 200 when the shovel relocation desirability value is high).

At 612, the instruction module 460 generates operator instruction information 498, which is presented to the operator via a user output device (such as display device 336). The operator instruction information 498 includes the vehicle queue information 496, generated by the dispatch module 420 based on the vehicle queue state information 480. In the illustrated embodiment of FIG. 4, the operator instruction information 498 is processed by the display module 450 to generate a GUI screen 900 (such as example GUI screen 900 described with reference to FIG. 9 below). The GUI screen 900 includes the operator instruction information 498, which includes the vehicle queue information 496 based on the vehicle queue state information 480. Thus, the operator is presented with a visual representation of the state of the queue 130, such as the total vehicle time lost to relocation, the total vehicle time spent in the queue 130, the shovel relocation desirability value, and/or a shovel relocation prompt. By showing the operator how much time vehicles have been idle in the queue 130, and/or how much time vehicles in the queue have lost to relocation of the power shovel 200, the operator is provided performance feedback that can be used to improve future performance and learn, over time, how to operate the shovel more efficiently. By presenting the operator with a shovel relocation prompt when the shovel relocation desirability value is high, the operator can be reminded to relocate the shovel at an opportune time to minimize vehicle time lost to shovel relocation.

Figure 7:
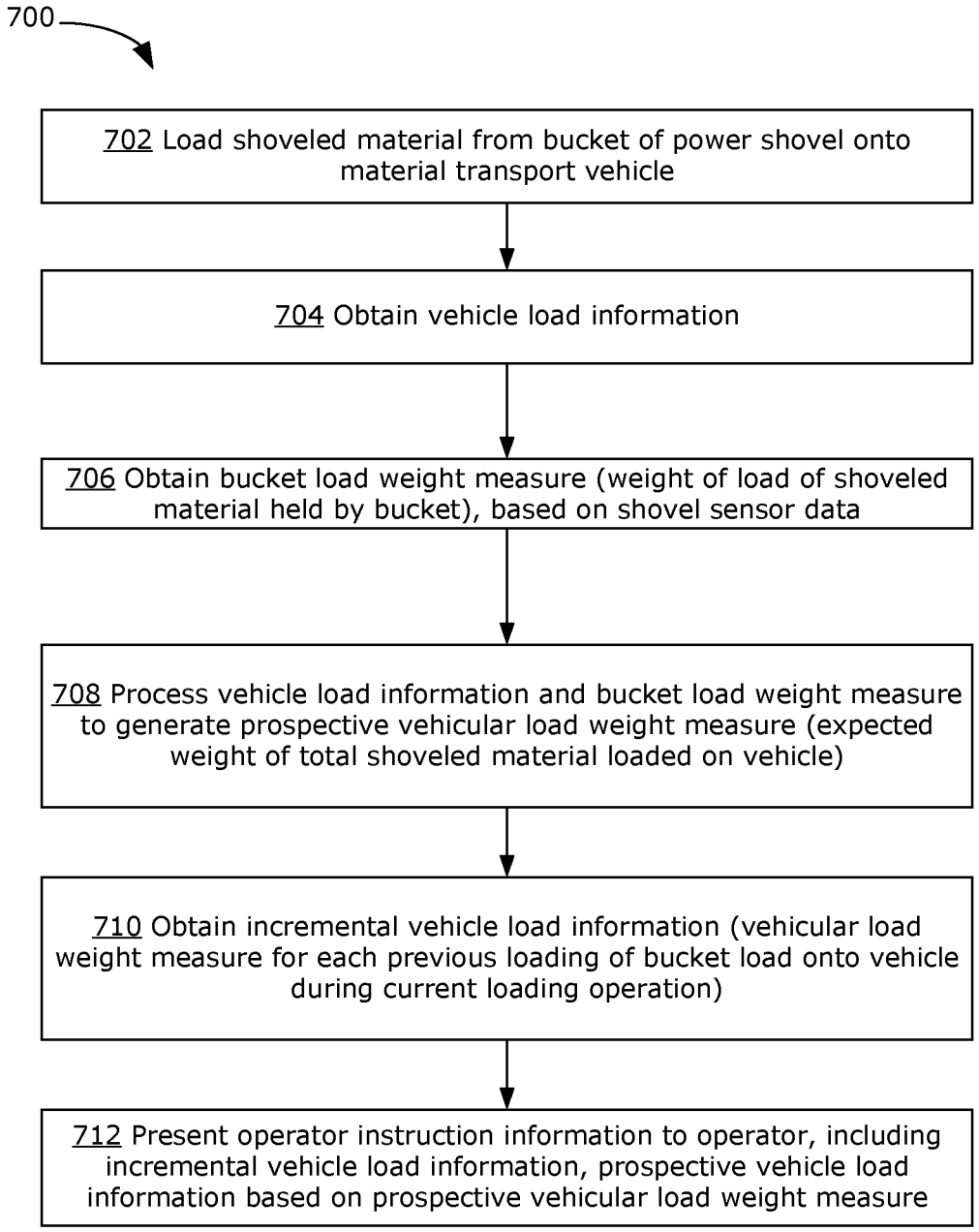
FIG. 7 is a flowchart illustrating steps of a third example method for instructing an operator of a power shovel, in accordance with examples described herein.

FIG. 7 is a flowchart showing steps of a third example method 700 for instructing an operator of a power shovel. The method 700 begins at step 702. At 702, the operator uses the power shovel 200 to load shoveled material from the bucket 208 of the power shovel 200 (i.e., bucket-contained shoveled material 150) onto a material transport vehicle, such that a loaded material transport vehicle is obtained (e.g., current vehicle 132 loaded with vehicle-contained shoveled material 152).

At 704, vehicle load information is obtained. The vehicle load information is representative of a weight of shoveled material loaded onto the loaded material transport vehicle (i.e., the vehicle-contained shoveled material 152). In some embodiments, the vehicle load information is based on vehicle weight sensor data from the weight sensor(s) 344 of the vehicle being loaded (i.e., current vehicle 132). In some embodiments, the vehicle sensor data 492, including vehicle weight sensor data, is received by the server network interface 320 and processed by the load estimating module 430 to generate the vehicle load information. In some embodiments, the vehicle load information is generated by a processor of a vehicle computer (not shown) by processing the weight sensor data from the weight sensors 344 of the vehicle, before sending the vehicle load information to the server 120.

At 706, the load estimating module 430 obtains a bucket load weight measure, representative of a weight of a load of the shoveled material held by the bucket 208 of the power shovel 200 (i.e., the bucket-contained shoveled material 150), based on shovel sensor data 491 generated by the sensor configuration of the power shovel 200 (i.e. the shovel sensors 330). In some embodiments, the bucket load weight measure is based on a non-calibrated weight measure of the power shovel weight sensors 334. However, in some embodiments the steps of method 500 described above are used to generate the bucket load weight measure: i.e., the bucket load weight measure is equal to the calibrated bucket load weight measure described above with reference to method 500.

At 708, the load estimating module 430 processes the vehicle load information and the bucket load weight measure to generate a prospective vehicular load weight measure. The prospective vehicular load weight measure is representative of an expected weight of total shoveled material (i.e., total vehicle-contained shoveled material 152) that will be loaded on the current vehicle 132 if the current bucket load of shoveled material (i.e., the current bucket-contained shoveled material 150) is transferred to the current vehicle 132. Thus, the prospective vehicular load weight measure models an expected weight of total shoveled material loaded on an additionally loaded material transport vehicle, wherein the additionally loaded material transport vehicle is a material transport vehicle that is obtained in response to loading of the bucket load (the current bucket-contained shoveled material 150) onto the loaded material transport vehicle (i.e. the current vehicle 132).

At 710, the load estimating module 430 obtains incremental vehicle load information. In some examples, the incremental vehicle load information can be obtained from the historical data stored in the server memory 324 by the historical data module 462 as part of the current loading operation information 476. For example, during the current loading operation (consisting of multiple material transfers from the bucket 208 to the current vehicle 132), the historical data module 462 stores the bucket load weight measure and/or the vehicle load information after each material transfer, such that a total weight of the shoveled material loaded on to the current vehicle 132 after each material transfer is stored. In various examples, the stored data is based on the shovel sensor data 491, the vehicle sensor data 492, or a combination thereof. Thus, the incremental vehicle load information is representative of, for each of one or more previous loadings of respective previous bucket loads onto the material transport vehicle (i.e. current vehicle 132) during a current loading operation, a previous vehicular load weight measure representative of a previous weight of shoveled material loaded onto the material transport vehicle.

At 712, the instruction module 460 generates operator instruction information 498, which is presented to the operator via a user output device (such as display device 336). The operator instruction information 498 includes prospective vehicle load information based on the prospective vehicular load weight measure. In some embodiments, the operator instruction information 498 also includes the incremental vehicle load information. The load estimating module 430 generates the load estimating information 494 (described above with reference to method 500) based on the prospective vehicular load weight measure and optionally the incremental vehicle load information, and sends the load estimating information 494 to the instruction module 460.

In the illustrated embodiment of FIG. 4, the operator instruction information 498 is processed by the display module 450 to generate a GUI screen 900 (such as example GUI screen 900 described with reference to FIG. 9 below). The GUI screen 900 includes the operator instruction information 498, which includes the prospective vehicle load information based on the prospective vehicular load weight measure, and optionally also the incremental vehicle load information. Thus, the operator is presented with a visual representation of the expected total weight of shoveled material carried by the current vehicle 132 if the current bucket load of shoveled material is transferred to the current vehicle 132. Optionally, the operator is also presented with a visual representation of the load on the current vehicle 132 after each material transfer during the current loading operation. These visual representations can be used to assist the operator in operating the power shovel 200 effectively: for example, to avoid overloading or underloading the current vehicle 132.

In some examples, the method 700 also includes a step (not shown) of processing the prospective vehicle load information to determine that the additionally loaded material transport vehicle will be overloaded. Vehicle payload target information is obtained, representative of a target payload of the material transport vehicle (i.e. current vehicle 132). The vehicle payload target information is compared to the prospective vehicular load weight measure to determine whether the additionally loaded material transport vehicle (i.e. current vehicle 132, after receiving the current bucket load) will be overloaded. In response to determining that the current vehicle 132 will be overloaded, the operator instruction information 498 further includes warning information indicating a risk of overloading. Thus, in some examples, the load estimating module 430 obtains vehicle payload target information, via the server network interface 320, indicating a target payload for the current vehicle 132, and this vehicle payload target information is compared to the prospective vehicular load weight measure to determine whether a warning should be displayed to the operator. In different examples, the vehicle payload target information can include a target payload weight (e.g., 4.3 tons), or a target payload weight range (e.g., 4.0-5.0 tons), for the vehicle. In some examples, different vehicles in the vehicle fleet 140 will have different vehicle payload target information, for example different models of haul truck or haul trucks having different levels of operational confidence will have different vehicle payload target information. In some embodiments, the vehicle payload target information is sent to the server 120 by each vehicle in the fleet 140. In some embodiments, the vehicle payload target information for one or more vehicles in the vehicle fleet 140 is stored and managed by the server 120, i.e. it is stored in the server memory 324.

Thus, in some examples, the vehicle payload target information is based at least in part on a vehicle type of the material transport vehicle (e.g., a different model of haul truck or a haul truck having a different maintenance or operational history).

In some examples, the vehicle payload target information is based at least in part on a condition of the shoveled material. For example, if the shoveled material is wet, there can be an increased risk of shoveled material spilling out of the bed of a material transport vehicle. Thus, the vehicle payload target information for any vehicles receiving wet shoveled material can be manually or automatically adjusted accordingly. For example, a human administrator of the server 120 can manually flag certain locations of the work site 104 as having wet conditions for the shoveled material; any vehicles dispatched to received shoveled material from power shovels at such locations can have their vehicle payload target information adjusted accordingly, by reducing the target payload weight or target payload weight range to reduce the chance of spillage in transit. It will be appreciated that any combination of manual and automatic adjustments to the target payload weight information can be effected using suitable techniques.

In some examples, the vehicle payload target information is based at least in part on a condition of a road surface of the work site 104. The roads driven by haul trucks to transport shoveled material from the power shovel 200 to the processing facility 110 can affect the risk of spillage of vehicle-contained shoveled material 152. If a road surface is known to be in poor condition—e.g., uneven or slippery—the target payload weight information can be adjusted to reduce the target payload weight or target payload weight range to reduce the chance of spillage in transit, using some combination of manual and/or automatic adjustment as described above with respect to the condition of the shoveled material.

Figure 8:
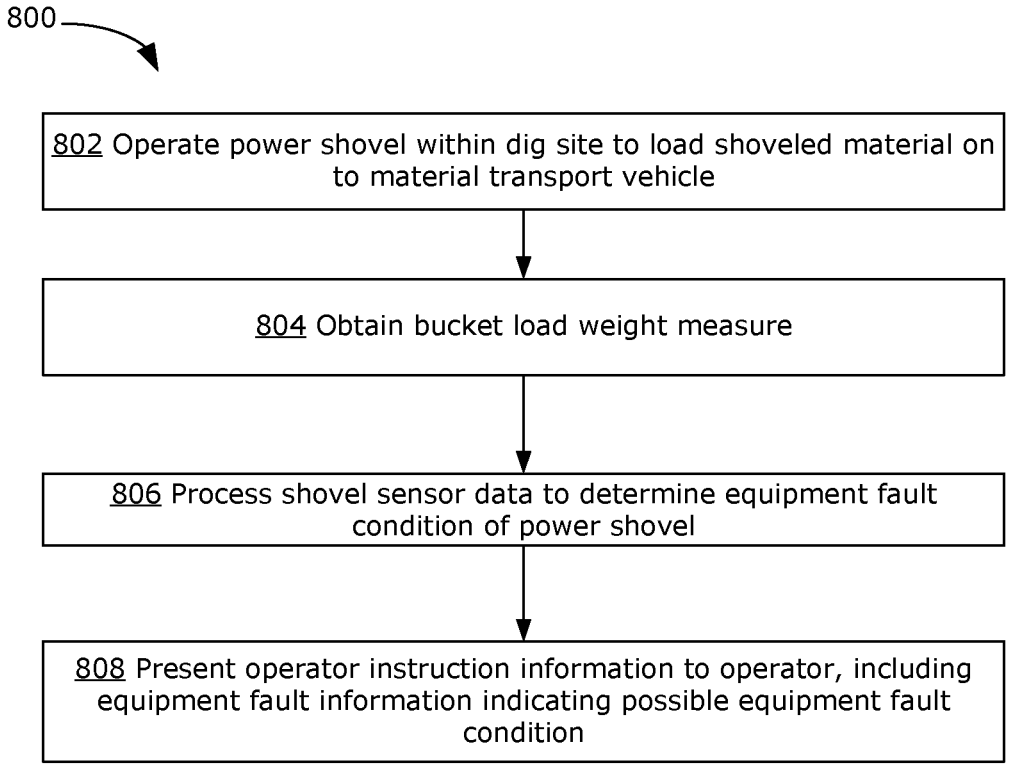
FIG. 8 is a flowchart illustrating steps of a fourth example method for instructing an operator of a power shovel, in accordance with examples described herein.

FIG. 8 is a flowchart showing steps of a fourth example method 800 for instructing an operator of a power shovel. The method 800 begins at step 802. At 802, the operator operates the power shovel 200 within the work site 104 to load shoveled material on to a material transport vehicle (e.g., current vehicle 132).

At 804, the load estimating module 430 obtains a bucket load weight measure, representative of a weight of a bucket load of the shoveled material held by a bucket of the power shovel (i.e. bucket-contained shoveled material 150), based on shovel sensor data 491 (e.g., shovel weight sensor data) generated by the sensor configuration of the power shovel (i.e. shovel sensors 330, specifically shovel weight sensors 334). The bucket load weight measure can be calibrated (as described above) or non-calibrated.

At 806, the load estimating module 430 processes at least the shovel sensor data 491 to determine an equipment fault condition of the power shovel 200. In some examples, the shovel sensor data 491 is compared to the vehicle sensor data 492 to detect a severe mismatch between weight readings of the shovel sensors 330 and vehicle sensors 340. For example, if a load of bucket-contained shoveled material 150 results in shovel weight sensor data indicating a weight of 0.8 tons, and the load of bucket-contained shoveled material 150 is transferred to the bed of the vehicle, resulting in vehicle weight sensor data indicating that the total amount of vehicle-contained shoveled material 152 has increased by 0.2 tons, this mismatch suggests a possible malfunction of the power shovel 200 (either the mechanical or structural components of the power shovel 200, or the shovel sensors 330) or the vehicle. In some examples, to avoid identifying an equipment fault condition based on a single accident (such as a bucket load of shoveled material being dumped on the ground instead of inside the vehicle bed), the shovel sensor data 491 is compared to the vehicle sensor data 492 over several material transfers in order to determine that the sensor readings are mismatched. In some examples, outlier data can be filtered out before making the determination.

In some examples, an equipment fault condition can indicate damage to the power shovel 200 due to improper operation of the power shovel 200. For example, bouncing incidents as described above can damage various components of the power shovel 200. In some embodiments, such damage can be detected using the shovel sensor data 491 and the vehicle sensor data 492. In some embodiments, adverse incidents potentially causing damage to the power shovel 200, such as boom jacking and slack rope events, can be detected using other techniques known in the field, potentially using other sensor types. Examples of such techniques include those described in US Patent Application Publication No. 2017/0121933 A1 to Brandt et al., entitled "CONTROL SYSTEM FOR MINING MACHINE", filed Oct. 28, 2015. It will be appreciated that slack ropes (e.g., the support cable 214 and/or hoist cable 212) can be detected using any of a number of known techniques for detecting slackness in ropes or cables.

At 808, the instruction module 460 generates operator instruction information 498, which is presented to the operator via a user output device (such as display device 336). The operator instruction information 498 includes equipment fault information indicating a possible equipment fault condition. In some embodiments, the possible equipment fault condition is as determined at step 806 based on the comparison of the shovel sensor data 491 to the vehicle sensor data 492. In some embodiments, possible equipment fault condition is determined at least in part based on the detection of a slack rope event or other adverse event potentially resulting in damage to the power shovel 200.

In the illustrated embodiment of FIG. 4, the operator instruction information 498 is processed by the display module 450 to generate a GUI screen 900 (such as example GUI screen 900 described with reference to FIG. 9 below). The GUI screen 900 includes the operator instruction information 498, which includes the equipment fault information indicating a possible equipment fault condition. Thus, the operator is presented with a warning or indication when a possible equipment fault is detected. Optionally, the operator is also presented with a warning or indication when a possible adverse event is detected. These visual representations can be used to assist the operator in operating the power shovel 200 effectively: for example, to identify adverse events when they occur (so they can be avoided in the future), and/or to avoid relying on possibly faulty sensor readings in the case of an equipment fault condition.

Example GUI Screens

Figure 9:
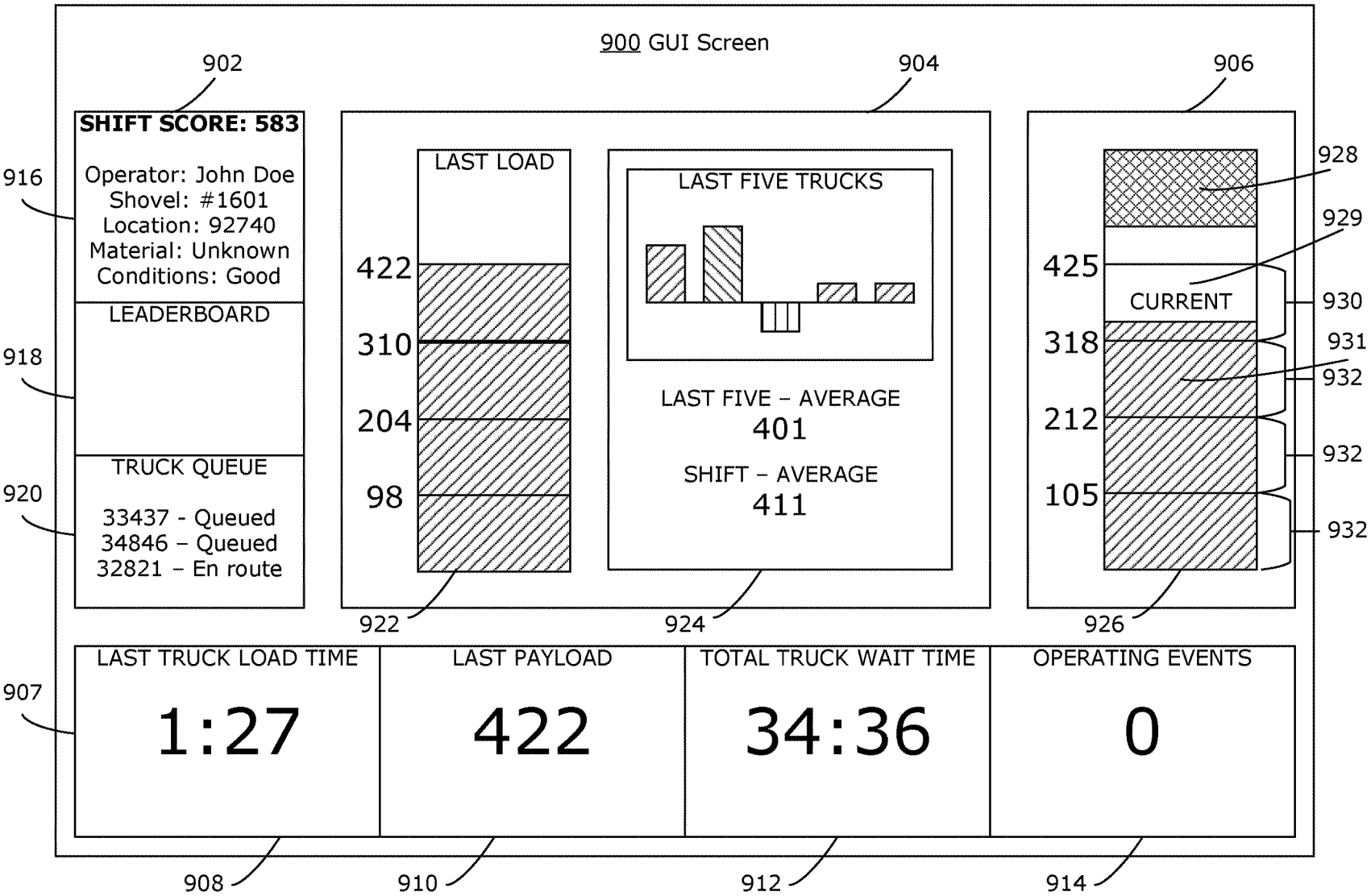
FIG. 9 is a first example GUI screen as generated by one or more of the methods of FIGS. 5-8 or the operator instruction module of FIG. 4.

FIG. 9 shows a first example GUI screen 900 as generated by one or more of the methods 500, 600, 700, or 800 of FIGS. 5-8. In addition to presenting one or more of the types of operator instruction information 498 described above with reference to the four methods 500, 600, 700, 800, GUI screen 900 also presents performance-related information 497 that integrates two or more of the types of information described above. In the context of the example operator instruction module 400 of FIG. 4, the performance-related information 497 is generated by the performance module 440. In some examples, the performance module 440 generates the performance-related information 497 based at least in part on the vehicle queue state information 480. In some examples, the performance module 440 generates the performance-related information 497 based at least in part on loading precision information. The loading precision information is representative of a precision of one or more of the calibration cycles, as described above with reference to method 500 (i.e. at least a portion of the loading operation information 470). In some examples, the performance module 440 generates the loading precision information 497 by processing, for each of the one or more of the calibration cycles, the loading operation information (e.g., for the first loading operation, first loading operation information 472) as well as the vehicle payload target information for the loading operation (as described above with reference to method 700). Specifically, in some embodiments, the vehicular load weight measure at the end of the loading operation (e.g. the final vehicular load weight measure of the first loading operation information 472) is compared to the vehicle payload target information for the vehicle being loaded (e.g. the vehicle loaded during the first loading operation), and this comparison is repeated over each calibration cycle being processed, to generate the loading precision information 497. Thus, in some examples, if each calibration cycle results in a final vehicular load weight measure within the target payload weight range for the vehicle (taking into account any adjustments to the vehicle payload target information as described above), then the loading precision information 497 will reflect an optimal (e.g., high) precision score for the operator. If one or calibration cycles results in a final vehicular load weight measure above the target payload weight range for the vehicle (i.e. the vehicle was overloaded by the power shovel 200 during the loading operation), then the loading precision information 497 will reflect a precision score decreased by a weighted amount related to the amount of overload. If one or calibration cycles results in a final vehicular load weight measure below the target payload weight range for the vehicle (i.e. the vehicle was underloaded by the power shovel 200 during the loading operation), then the loading precision information 497 will reflect a precision score decreased by a weighted amount related to the amount of underload. In some embodiments, overload amounts will be weighted more heavily than underload amounts in determining the precision score.

In some embodiments, the performance-related information further includes shovel event information representative of the occurrence of one or more events adversely affecting a condition of the power shovel 200. In some embodiments, these adverse events include those adverse events described above with reference to method 800, i.e. slack rope or boom jacking events. In some embodiments, these adverse events include detection of possible equipment fault conditions caused by improper operation of the power shovel 200. It will be appreciated that other adverse events caused by improper operation of the power shovel 200 can also be included in the category of adverse events for inclusion in the shovel event information.

In some embodiments, the performance-related information includes one or more of the following, collected over a period of time such as a work shift: the total vehicle time lost to shovel relocation, the total vehicle wait time in the queue, the number of adverse events detected, the loading precision information 497, and a total vehicle load time for one or more loading operations.

The performance-related information 497 is processed by the instruction module 460 to generate performance information, which is included in the operator instruction information 498 presented to the operator as part of the GUI screen 900.

GUI screen 900 thus presents various types of operator instruction information 498. A left panel 902 displays a summary section 916, a leaderboard section 918, and a truck queue section 920. The summary section 916 displays a shift score representative of at least a portion of the performance information, computed over the current work shift of the current operator. The summary section 916 also displays other pertinent information, including the name of the current operator, an identifier for the power shovel 200, an identifier for the current location (e.g. first location 106) of the power shovel 200, a condition or type of the shoveled material, and conditions of the work site 104 generally. The leaderboard section 918 is used to display a comparison of the operator's performance information (such as the shift score) to performance information of other operators operating at the work site 104, either currently or in the past. The truck queue section 920 displays at least a portion of the vehicle queue information described above, such as the number of queued vehicles, an identifier for each queued vehicle, and/or other vehicle queue information.

A bottom panel 907 displays a last truck load time section 908, a last payload section 910, a total truck wait time section 912, and an operating events section 914. The last truck load time section 908 displays a total vehicle load time during which the previous loading operation (e.g., the (n−1) th loading operation, as represented by the (n−1)th loading operation information 474) took place. This metric can be factored into the performance information (e.g., the shift score) to encourage an operator to load each vehicle more quickly and efficiently. The last payload section 910 displays the total weight of vehicle-contained shoveled material 152 at the end of the previous loading operation. This metric can assist the operator in calibrating or planning the total payload to be loaded onto the current vehicle, assuming that the previous vehicle (e.g., previously-loaded vehicle 144) and the current vehicle 132 are of the same type. The total truck wait time section 912 displays a total vehicle time spent in the queue 130 over, e.g., the current work shift. This metric can remind the operator to minimize delays when the queue 130 contains multiple vehicles, and can provide feedback on the extent of such delays during the current time period. The operating events section 914 displays the number of detected adverse events. This metric can warn the operator to avoid such events in the future. Each of the metrics displayed in the bottom panel 907 can be included in generating the performance information (e.g., the shift score) in some examples.

A center panel 904 includes a last load incremental display 922 and a last five trucks summary section 924. The last load incremental display 922 shows the incremental vehicle load information for the previous loading operation (e.g., for the (n−1)th loading operation, as represented by the (n−1)th loading operation information 474). In the illustrated example, the incremental vehicle load information is shown as both a stacked column chart and a set of numerical values representing the total weight of vehicle-contained shoveled material 152 loaded into the vehicle (e.g., previously-loaded vehicle 144) at the end of each material transfer of the previous loading operation. Thus, the illustrated example shows the incremental vehicle load information as including four material transfers, resulting in total weights of vehicle-contained shoveled material 152 of 98, 204, 310, and 422 units respectively (wherein the units can indicate any unit of weight, e.g., ten kilograms each). In other embodiments, the numerical values can instead reflect the incremental amount of shoveled material added by each material transfer rather than the total amount following the material transfer.

The last five trucks summary section 924 displays a summary of one or more loading previous operations (shown here as the last five loading operations). A visual representation based on the precision information for the last five loading operations is shown: each loading operations is shown as being over or under a payload target for the vehicle, and the amount overloaded or underloaded, as a bar graph. In some embodiments, the degree of overloading or underloading is categorized as minor (e.g., less than 20%) or major (e.g., 20% or more), or according to some other scheme, and the bars of the bar graph are colored to reflect the category. The last five trucks summary section 924 also displays a summary of loading precision over one or more previous loading operations, shown in this illustration as an average vehicle load weight over the last five loading operations, as well as an average vehicle load weight over all loading operations in the current work shift.

A right panel 906 includes a current load incremental display 926. The current load incremental display 926 is very similar to the last load incremental display 922, but it reflects the current (i.e., nth) loading operation information 476 instead of the previous (i.e., (n−1)th) loading operation information 474, and it updates in real time based on the ongoing material transfers of the current loading operation. The incremental vehicle load information for the current (i.e., nth) loading operation is shown as three incremental blocks 932, each corresponding to a previous material transfer during the current loading operation. The top of each incremental block 932 corresponds to the total weight of vehicle-contained shoveled material 152 loaded into the vehicle (e.g., current vehicle 132) at the end of each material transfer of the current loading operation (shown as 105, 212, and 318 weight units, respectively). A current bucket load block 930 corresponds to the size of the calibrated bucket load weight measure, i.e. the calibrated measure of the weight of the current bucket-contained shoveled material 150. A target range block 929 (shown as a non-shaded region) corresponds to the target payload weight range of the current vehicle 132: an underload region 931 corresponds to an underloaded vehicle, whereas an overloaded region 928 corresponds to an overloaded vehicle. Thus, the top of the current bucket load block 930 corresponds to the prospective vehicular load weight measure of method 500.

By showing the operator, in real time, the prospective vehicular load weight measure (i.e. top of block 930) as it relates to the underload region 931, overloaded region 928, and target range block 929, the operator can easily estimate whether transferring the current bucket load of shoveled material to the current vehicle 132 will result in underload, overload, or a load within the target payload weight range. The operator can operate the power shovel accordingly, e.g., by only partially emptying the bucket 208 into the current vehicle 132 to avoid overload, or by digging additional material to avoid underload.

In some embodiments, in response to detecting that the prospective vehicular load weight measure is within the overload region 928, a warning is displayed indicating a risk of overloading, as described above with reference to method 700. In some embodiments, the warning is displayed over or proximate to the current load incremental display 926.

Figure 9A:
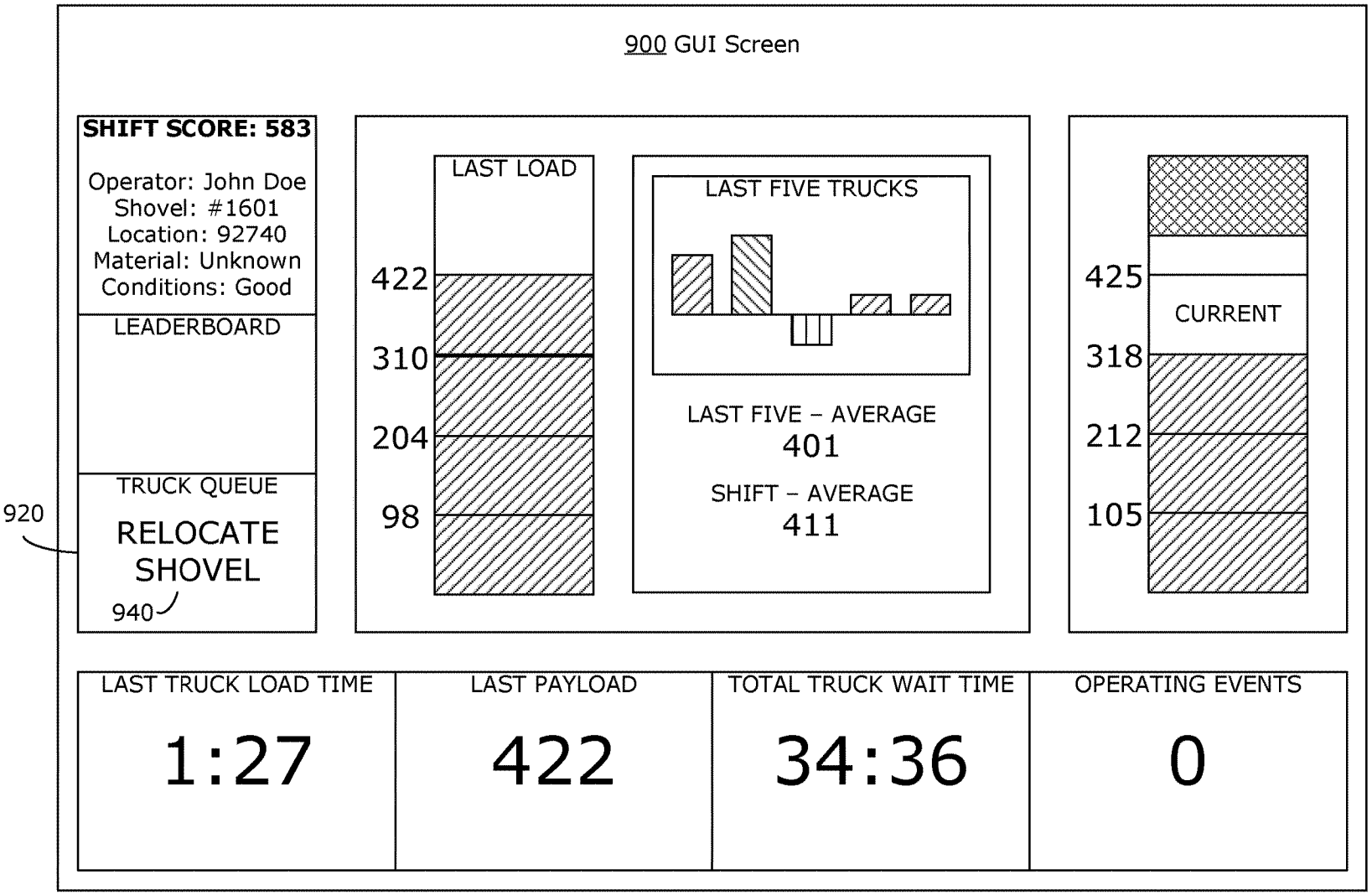
FIG. 9A is a second example of the GUI screen of FIG. 9.

FIG. 9A shows a second example GUI screen 900A. The second example GUI screen 900A differs from the first example GUI screen 900 insofar as the truck queue section 920 shows a shovel relocation prompt 940 (shown as the text "RELOCATE SHOVEL"). The shovel relocation prompt 940 can be displayed under certain conditions, as described above with reference to method 600: for example, the shovel relocation prompt 940 can be displayed when the queue 130 is empty and no vehicles are currently dispatched to the location of the power shovel 200.

Figure 9B:
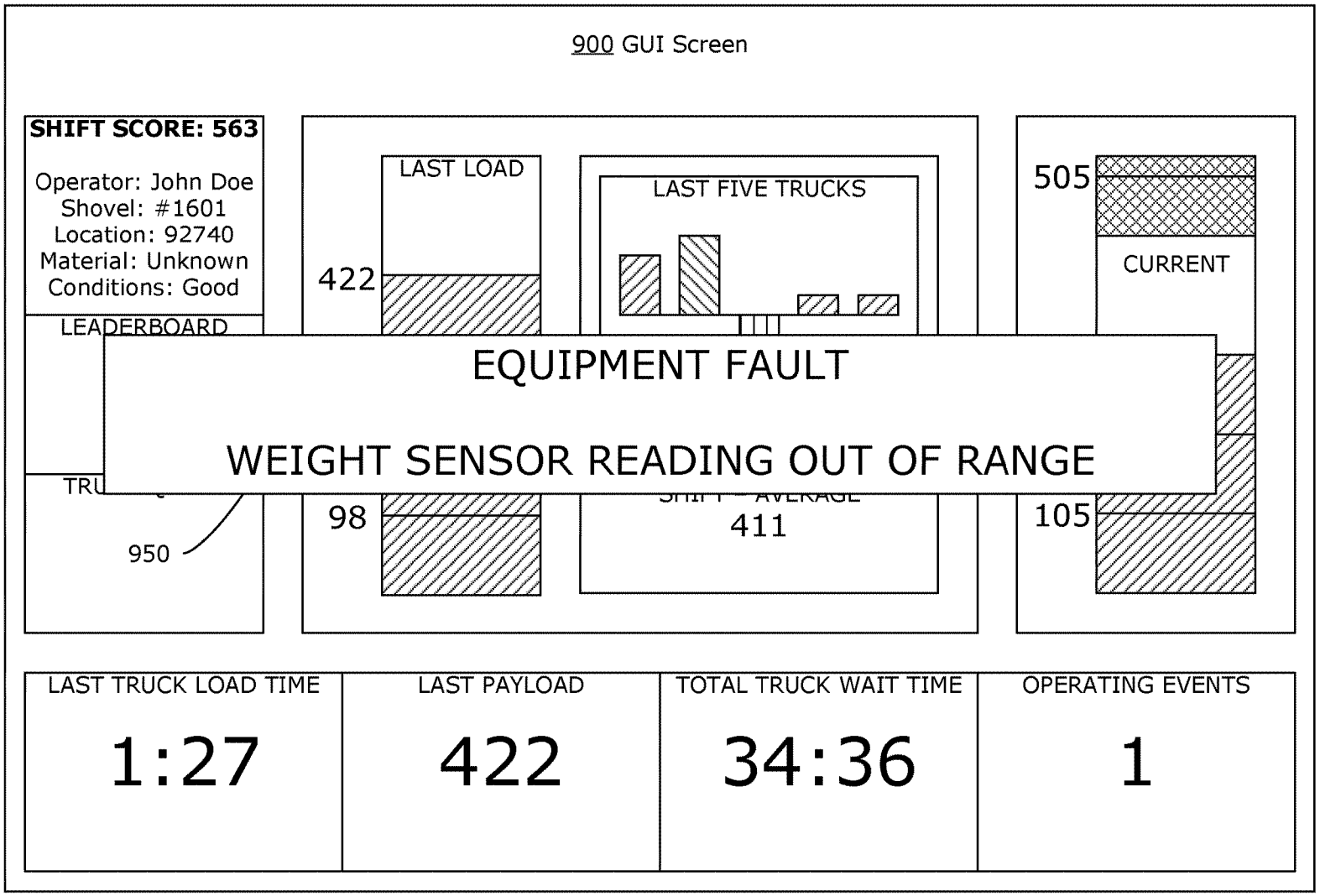
FIG. 9B is a third example of the GUI screen of FIG. 9.

FIG. 9B shows a third example GUI screen 900B. The third example GUI screen 900B differs from the first example GUI screen 900 in three respects: first, the current bucket load block 930 of the current load incremental display 926 shows a larger weight measure than in first example GUI screen 900; second, equipment fault information is displayed in the form of an equipment fault warning 950, indicating a possible equipment fault condition related to the shovel weight sensor(s) 334; and third, the number of adverse vents shown in the operating events section 914 is one instead of zero. Taken together, these differences suggest that an adverse event has damaged or misaligned the weight sensor(s) 334 of the power shovel 200, leading to an inflated bucket weight measure.

In some embodiments, the operator instruction module 400 is configured to operate in both a training mode and an instruction mode, depending on the configuration of various data parameters. The server memory 324 is used to store operator status information for each operator of the power shovel 200. When an operator starts a work shift, or at some other time, the operator instruction module 400 obtains the operator status information for the current operator (which can also include some of the information displayed in the summary section 916 of GUI screen 900, such as the operator's name). If the operator status information indicates that the current operator of the power shovel 200 is not undergoing training (e.g., the operator is already fully trained), then the operator instruction module 400 operates in the instruction mode, in which the behavior of the operator instruction module 400 is as described above. On the other hand, if the operator status information indicates that the current operator of the power shovel 200 is undergoing training, the operator instruction module 400 operates in the training mode, in which the operator training information 498 excludes the performance information from the GUI screen 900. Thus, in some examples, one or more of the performance indicators shown in the summary section 916 (e.g., the shift score) and/or the bottom panel 907 (e.g., the total vehicle load time, the total weight of vehicle-contained shoveled material 152 at the end of the previous loading operation, the total vehicle time spent in the queue 130, and/or the number of detected adverse events) is omitted from the GUI screen 900. The reduced performance information shown to the operator in training avoids overloading the operator with too much information and allows the operator to focus on learning the basics without trying to compete with more experienced operators.

General

Although the present disclosure describes methods and processes with steps in a certain order, one or more steps of the methods and processes can be omitted or altered as appropriate. One or more steps can take place in an order other than that in which they are described, as appropriate.

Although the present disclosure is described, at least in part, in terms of methods, a person of ordinary skill in the art will understand that the present disclosure is also directed to the various components for performing at least some of the aspects and features of the described methods, be it by way of hardware components, software or any combination of the two. Accordingly, the technical solution of the present disclosure can be embodied in the form of a software product. A suitable software product can be stored in a pre-recorded storage device or other similar non-volatile or non-transitory computer readable medium, including DVDs, CD-ROMs, USB flash disk, a removable hard disk, or other storage media, for example. The software product includes instructions tangibly stored thereon that enable a processing device (e.g., a personal computer, a server, or a network device) to execute examples of the methods disclosed herein.

The present disclosure can be embodied in other specific forms without departing from the subject matter of the claims. The described example embodiments are to be considered in all respects as being only illustrative and not restrictive. Selected features from one or more of the above-described embodiments can be combined to create alternative embodiments not explicitly described, features suitable for such combinations being understood within the scope of this disclosure.

All values and sub-ranges within disclosed ranges are also disclosed. Also, although the systems, devices and processes disclosed and shown herein can comprise a specific number of elements/components, the systems, devices and assemblies could be modified to include additional or fewer of such elements/components. For example, although any of the elements/components disclosed can be referenced as being singular, the embodiments disclosed herein could be modified to include a plurality of such elements/components. The subject matter described herein intends to cover and embrace all suitable changes in technology.

The invention claimed is:

1. A method for calibrating a bucket load weight measure for a power shovel within a work site, wherein the power shovel includes a bucket, comprising:

over a plurality of calibration cycles, wherein each one of the calibration cycles, independently, includes digging a material with the power shovel, such that the material becomes disposed within the bucket of the power shovel, and transferring the material to at least one material transport vehicle, with effect that a total amount of material is transferred from the bucket to the at least one material transport vehicle over the plurality of calibration cycles:

obtaining a bucket calibration measure representative of the total amount of material disposed within the bucket during the plurality of calibration cycles, wherein, for each one of the plurality calibration cycles, independently, a bucket sensor on the power shovel senses a weight of material disposed in the bucket and the bucket calibration measure is the cumulative sensed weight of material in the bucket across the plurality of calibration cycles;

obtaining a vehicle calibration measure representative of the total amount of material disposed in the at least one material transport vehicle, wherein, for each one of the plurality of calibration cycles, independently, a vehicle sensor on the at least one material transport vehicle senses a weight of material transferred from the bucket to the material transport vehicle and the vehicle calibration measure is the cumulative sensed weight of material transferred to the at least one material transport vehicle across the plurality of calibration cycles;

determining a calibration ratio of the bucket calibration measure to the vehicle calibration measure; and during operation of the power shovel in a loading operation comprising one or more transfers of material from the bucket to a current material transport vehicle:

obtaining a working bucket load weight measure, representative of a weight of material disposed within the bucket of the power shovel, based on the bucket sensor; and generating a calibrated bucket load weight measure based on the working bucket load weight measure and the calibration ratio.

2. The method of claim 1, wherein the calibrated bucket load weight measure is generated by dividing the working bucket load weight measure by the calibration ratio to compute the calibrated bucket load weight measure.

3. The method of claim 1, further comprising:

during the loading operation, presenting to an operator of the power shovel, via a user output device, operator instruction information including bucket load information based on the calibrated bucket load weight measure.

4. The method of claim 3, further comprising:

during the loading operation, obtaining vehicle queue state information representative of a state of a queue of the one or more material transport vehicles at a current location of the power shovel;

wherein the operator instruction information further includes vehicle queue information based on the vehicle queue state information.

5. The method of claim 4, further comprising processing the vehicle queue state information to generate a shovel relocation desirability value;

wherein the operator instruction information further includes a relocation prompt based on the shovel relocation desirability value.

6. The method of claim 4, further comprising processing the vehicle queue state information to generate a shovel relocation desirability value;

wherein:

the vehicle queue state information includes:

a number of material transport vehicles in the queue; and a number of material transport vehicle currently dispatched to the current location of the power shovel; and the operator instruction information includes a relocation prompt based on the shovel relocation desirability value.

7. The method of claim 3, further comprising:

during the loading operation, obtaining a vehicular load weight measure representative of a current weight of the material transferred to the material transport vehicle; and processing the calibrated bucket load weight measure to generate a prospective vehicular load weight measure representative of an expected weight of the vehicle-contained shoveled material if the shoveled material held by the bucket of the power shovel is transferred to the material transport vehicle;

wherein the operator instruction information further includes prospective vehicle load information based on the prospective vehicular load weight measure.

8. The method of claim 7:

further comprising obtaining vehicle payload target information representative of a target payload of the material transport vehicle;

wherein processing the prospective vehicle load information to determine that the material transport vehicle will be overloaded if the bucket load is transferred to the material transport vehicle comprises comparing the vehicle payload target information to the prospective vehicle load information.

9. The method of claim 3:

further comprising:

processing at least the shovel sensor data to determine an equipment fault condition of the power shovel;

wherein the operator instruction information further includes equipment fault information indicating a possible equipment fault condition.

10. The method of claim 3:

further comprising:

obtaining performance-related information including:

vehicle queue state information representative of a state of a queue of material transport vehicles of the material transport vehicular fleet at a current location of the power shovel; and loading precision information representative of a precision of one or more of the calibration cycles of the plurality of calibration cycles;

and processing the performance-related information to generate performance information;

wherein the operator instruction information further includes the performance information.

11. A system for instructing an operator of a power shovel within a work site, comprising:

a display device;

a processor; and a memory storing machine-executable instructions thereon which, when executed by the processor, cause the system to calibrate a bucket load weight measure for the power shovel, wherein the power shovel includes a bucket, by:

over a plurality of calibration cycles, wherein each one of the calibration cycles, independently, includes digging a material with the power shovel, such that the material becomes disposed within the bucket of the power shovel, and transferring the material to at least one material transport vehicle, with effect that a total amount of material is transferred from the bucket to the at least one material transport vehicle over the plurality of calibration cycles:

obtaining a bucket calibration measure representative of the total amount of material disposed within the bucket during the plurality of calibration cycles, wherein, for each one of the plurality calibration cycles, independently, a bucket sensor on the power shovel senses a weight of material disposed in the bucket and the bucket calibration measure is the cumulative sensed weight of material in the bucket across the plurality of calibration cycles;

obtaining a vehicle calibration measure representative of the total amount of material disposed in the at least one material transport vehicle, wherein, for each one of the plurality of calibration cycles, independently, a vehicle sensor on the at least one material transport vehicle senses a weight of material transferred from the bucket to the material transport vehicle and the vehicle calibration measure is the cumulative sensed weight of material transferred to the at least one material transport vehicle across the plurality of calibration cycles;

determining a calibration ratio of the bucket calibration measure to the vehicle calibration measure;

and during operation of the power shovel in a loading operation comprising one or more transfers of material from the bucket to a current material transport vehicle:

obtaining a working bucket load weight measure, representative of a weight of material disposed within the bucket of the power shovel, based on the bucket sensor; and generating a calibrated bucket load weight measure based on the working bucket load weight measure and the calibration ratio.

12. The system of claim 11, wherein the calibrated bucket load weight measure is generated by dividing the working bucket load weight measure by the calibration ratio to compute the calibrated bucket load weight measure.

13. The system of claim 11, wherein the system further calibrates the bucket load weight measure for the power shovel by:

during the loading operation, presenting to an operator of the power shovel, via a user output device, operator instruction information including bucket load information based on the calibrated bucket load weight measure.

14. The system of claim 13, wherein the system further calibrates the bucket load weight measure for the power shovel by:

during the loading operation, obtaining vehicle queue state information representative of a state of a queue of the one or more material transport vehicles at a current location of the power shovel;

wherein the operator instruction information further includes vehicle queue information based on the vehicle queue state information.

15. The system of claim 14, wherein the system further calibrates the bucket load weight measure for the power shovel by processing the vehicle queue state information to generate a shovel relocation desirability value;

wherein the operator instruction information further includes a relocation prompt based on the shovel relocation desirability value.

16. The system of claim 14, wherein the system further calibrates the bucket load weight measure for the power shovel by processing the vehicle queue state information to generate a shovel relocation desirability value;

wherein:

the vehicle queue state information includes:

a number of material transport vehicles in the queue; and a number of material transport vehicle currently dispatched to the current location of the power shovel; and the operator instruction information includes a relocation prompt based on the shovel relocation desirability value.

17. The system of claim 13, wherein the system further calibrates the bucket load weight measure for the power shovel by:

during the loading operation, obtaining a vehicular load weight measure representative of a current weight of the material transferred to the material transport vehicle; and processing the calibrated bucket load weight measure to generate a prospective vehicular load weight measure representative of an expected weight of the vehicle-contained shoveled material if the shoveled material held by the bucket of the power shovel is transferred to the material transport vehicle;

wherein the operator instruction information further includes prospective vehicle load information based on the prospective vehicular load weight measure.

18. The system of claim 17:

wherein the system further calibrates the bucket load weight measure for the power shovel by obtaining vehicle payload target information representative of a target payload of the material transport vehicle;

wherein processing the prospective vehicle load information to determine that the material transport vehicle will be overloaded if the bucket load is transferred to the material transport vehicle comprises comparing the vehicle payload target information to the prospective vehicle load information.

19. The system of claim 13:

wherein the system further calibrates the bucket load weight measure for the power shovel by:

processing at least the shovel sensor data to determine an equipment fault condition of the power shovel;

wherein the operator instruction information further includes equipment fault information indicating a possible equipment fault condition.

20. The system of claim 13:

wherein the system further calibrates the bucket load weight measure for the power shovel by:

obtaining performance-related information including:

vehicle queue state information representative of a state of a queue of material transport vehicles of the material transport vehicular fleet at a current location of the power shovel; and loading precision information representative of a precision of one or more of the calibration cycles of the plurality of calibration cycles;

and processing the performance-related information to generate performance information;

wherein the operator instruction information further includes the performance information.

21. A non-transitory processor-readable medium having machine-executable instructions stored thereon which, when executed by a processor of a device, cause the device to calibrate a bucket load weight measure for a power shovel within a work site, wherein the power shovel includes a bucket, by:

over a plurality of calibration cycles, wherein each one of the calibration cycles, independently, includes digging a material with the power shovel, such that the material becomes disposed within the bucket of the power shovel, and transferring the material to at least one material transport vehicle, with effect that a total amount of material is transferred from the bucket to the at least one material transport vehicle over the plurality of calibration cycles:

obtaining a bucket calibration measure representative of the total amount of material disposed within the bucket during the plurality of calibration cycles, wherein, for each one of the plurality calibration cycles, independently, a bucket sensor on the power shovel senses a weight of material disposed in the bucket and the bucket calibration measure is the cumulative sensed weight of material in the bucket across the plurality of calibration cycles;

obtaining a vehicle calibration measure representative of the total amount of material disposed in the at least one material transport vehicle, wherein, for each one of the plurality of calibration cycles, independently, a vehicle sensor on the at least one material transport vehicle senses a weight of material transferred from the bucket to the material transport vehicle and the vehicle calibration measure is the cumulative sensed weight of material transferred to the at least one material transport vehicle across the plurality of calibration cycles;

determining a calibration ratio of the bucket calibration measure to the vehicle calibration measure;

and during operation of the power shovel in a loading operation comprising one or more transfers of material from the bucket to a current material transport vehicle:

obtaining a working bucket load weight measure, representative of a weight of material disposed within the bucket of the power shovel, based on the bucket sensor; and generating a calibrated bucket load weight measure based on the working bucket load weight measure and the calibration ratio.

* * * * *